US010761466B2

(12) United States Patent
Yamada et al.

(10) Patent No.: US 10,761,466 B2
(45) Date of Patent: Sep. 1, 2020

(54) FIXING DEVICE FOR SETTING THE GLOSSINESS OF THE TONER IMAGE

(71) Applicant: Konica Minolta, Inc., Tokyo (JP)

(72) Inventors: Chiaki Yamada, Osaka (JP); Naoki Yoshie, Osaka (JP); Hirofumi Nakagawa, Osaka (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 16/433,770

(22) Filed: Jun. 6, 2019

(65) Prior Publication Data

US 2019/0384213 A1 Dec. 19, 2019

(30) Foreign Application Priority Data

Jun. 15, 2018 (JP) ..... 2018-114324

(51) Int. Cl.
*G03G 15/20* (2006.01)
*G03G 15/16* (2006.01)
*G03G 15/10* (2006.01)

(52) U.S. Cl.
CPC ..... *G03G 15/2064* (2013.01); *G03G 15/105* (2013.01); *G03G 15/169* (2013.01); *G03G 15/1675* (2013.01)

(58) Field of Classification Search
USPC ..... 399/328
See application file for complete search history.

(56) References Cited

U.S. PATENT DOCUMENTS

2004/0042809 A1* 3/2004 Fuma ..... G03G 15/2064 399/67
2011/0194869 A1* 8/2011 Yoshinaga ..... G03G 15/2064 399/69
2013/0209150 A1* 8/2013 Kamoda ..... G03G 15/2021 399/341

FOREIGN PATENT DOCUMENTS

JP 2004-286992 A 10/2004
JP 2008203558 A * 9/2008
JP 2016-177206 A 10/2016

* cited by examiner

*Primary Examiner* — Quana Grainger
(74) *Attorney, Agent, or Firm* — Squire Patton Boggs (US) LLP

(57) ABSTRACT

A fixing device includes: a fixing member that heats a toner image formed on a recording sheet in order to fix the toner image on the recording sheet; a pressurizing member that nips the recording sheet together with the fixing member to pressurize the toner image on the recording sheet; a heater that heats the pressurizing member; and a hardware processor that controls a heating temperature of the pressurizing member by the heater, wherein the hardware processor acquires setting of glossiness of the toner image and controls the heating temperature to be higher as the glossiness in the setting is lower.

9 Claims, 8 Drawing Sheets

FIG. 4

| TONER TYPE | METAL ELEMENT | |
|---|---|---|
| | ELEMENT | CONTENT (% BY MASS) |
| TONER (1) | Mg | 0.40 |
| TONER (2) | Mg | 0.31 |
| TONER (3) | Mg | 0.16 |
| TONER (4) | Mg | 0.05 |
| TONER (5) | Al | 0.16 |
| TONER (6) | Al | 0.05 |
| TONER (7) | Mg | 0.03 |
| TONER (8) | Mg | 0.50 |

FIG. 8

| EXAMPLE | TONER TYPE | METAL ELEMENT | | PROCESS CONDITION | | | EVALUATION RESULT | |
|---|---|---|---|---|---|---|---|---|
| | | ELEMENT | CONTENT (% BY MASS) | FIXING MEMBER TEMPERATURE (°C) | PRESSURIZING MEMBER TEMPERATURE (°C) | NIPPING PRESSURE (kPa) | GLOSS | FIXING STRENGTH |
| EXAMPLE 1 | TONER (1) | Mg | 0.40 | 160<br>↑<br>↑ | 30<br>60<br>90 | 200<br>↑<br>↑ | 52<br>38<br>18 | ○<br>○<br>○ |
| EXAMPLE 2 | TONER (2) | Mg | 0.31 | 170<br>↑<br>↑ | 30<br>60<br>90 | 200<br>↑<br>↑ | 55<br>44<br>34 | ◎<br>◎<br>◎ |
| EXAMPLE 3 | TONER (2) | Mg | 0.31 | 170<br>↑<br>↑ | 30<br>60<br>90 | 200<br>150<br>100 | 55<br>33<br>21 | ◎<br>◎<br>◎ |
| EXAMPLE 4 | TONER (3) | Mg | 0.16 | 170<br>↑<br>↑ | 30<br>60<br>90 | 200<br>↑<br>↑ | 56<br>46<br>36 | ◎<br>◎<br>◎ |
| EXAMPLE 5 | TONER (4) | Mg | 0.05 | 180<br>↑<br>↑ | 30<br>60<br>90 | 200<br>↑<br>↑ | 59<br>52<br>45 | ◎<br>◎<br>◎ |
| EXAMPLE 6 | TONER (5) | Al | 0.16 | 160<br>↑<br>↑ | 30<br>60<br>90 | 200<br>↑<br>↑ | 46<br>37<br>29 | ◎<br>◎<br>◎ |
| EXAMPLE 7 | TONER (6) | Al | 0.05 | 160<br>↑<br>↑ | 30<br>60<br>90 | 200<br>↑<br>↑ | 52<br>45<br>39 | ◎<br>◎<br>◎ |
| EXAMPLE 8 | TONER (7) | Mg | 0.03 | 160<br>↑<br>↑ | 30<br>60<br>90 | 200<br>↑<br>↑ | 62<br>60<br>61 | ◎<br>◎<br>◎ |
| EXAMPLE 9 | TONER (8) | Mg | 0.50 | 160<br>↑<br>↑ | 30<br>60<br>90 | 200<br>↑<br>↑ | 48<br>37<br>18 | △<br>△<br>△ |

FIXING DEVICE FOR SETTING THE GLOSSINESS OF THE TONER IMAGE

The entire disclosure of Japanese patent Application No. 2018-114324, filed on Jun. 15, 2018, is incorporated herein by reference in its entirety.

BACKGROUND

Technological Field

The present disclosure relates to fixation of a toner image in electrophotographic image formation.

Description of the Related Art

In electrophotographic image formation, an unfixed toner image formed on a recording sheet is fixed on the recording sheet by a fixing step of applying heat and pressure. Conventionally, various devices have been proposed as a fixing device that fixes an unfixed toner image on a recording sheet. As a method for controlling glossiness of an image formed in such image formation, JP 2004-286992 A provides a technique of changing fixing time and fixing temperature in a fixing device.

JP 2016-177206 A points out that glossiness of a toner image changes after the toner image is discharged from a fixing nip portion even when fixing time and fixing temperature are controlled. In addition, JP 2016-177206 A proposes that by providing a means for adjusting the temperature of a recording material on an upstream side and/or a downstream side of the fixing nip portion, a curing rate of a toner image that has passed through the nip portion is adjusted to obtain an image of target glossiness.

However, according to the technique described in JP 2016-177206 A, by providing the temperature adjustment means on the upstream side/downstream side of the nip portion, the size of the fixing device increases. Furthermore, the means consumes energy, and the amount of energy required for obtaining the target glossiness thereby increases.

SUMMARY

The present disclosure has been achieved in view of the above circumstances, and an object thereof is to control the glossiness of a toner image while avoiding an increase in size of a device and suppressing the consumption amount of energy.

To achieve the above mentioned object, according to an aspect of the present invention, a fixing device reflecting one aspect of the present invention comprises: a fixing member that heats a toner image formed on a recording sheet in order to fix the toner image on the recording sheet; a pressurizing member that nips the recording sheet together with the fixing member to pressurize the toner image on the recording sheet; a heater that heats the pressurizing member, and a hardware processor that controls a heating temperature of the pressurizing member by the heater, wherein the hardware processor acquires setting of glossiness of the toner image and controls the heating temperature to be higher as the glossiness in the setting is lower.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 4 is a diagram illustrating the contents of metal elements of toners;

FIG. 8 is a diagram illustrating a specific example of gloss of a toner image of a printed matter generated under each of nine conditions.

DETAILED DESCRIPTION OF EMBODIMENTS

Figure 1:
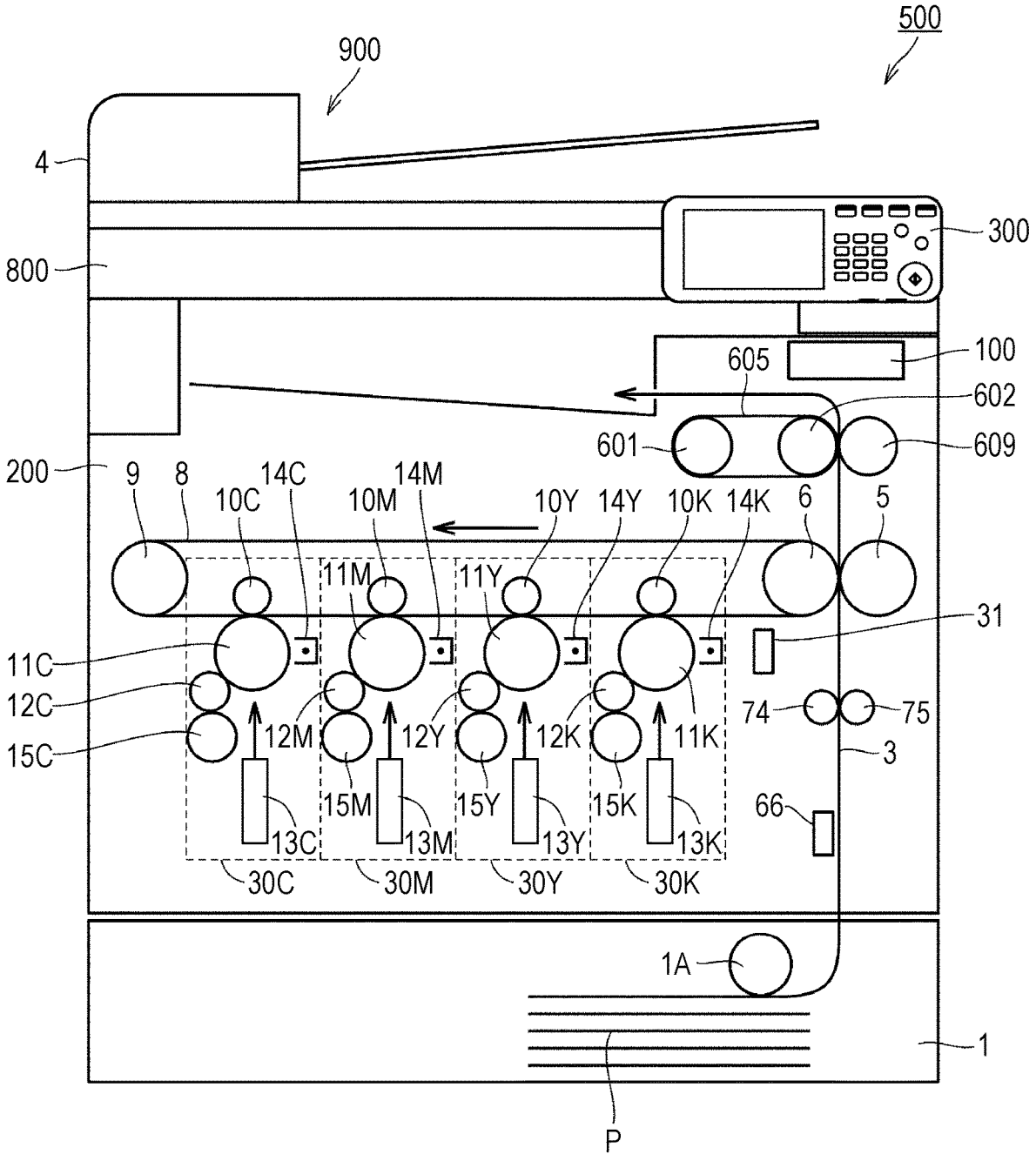
FIG. 1 is a diagram schematically illustrating a configuration of an MFP which is an example of an image forming device.

Hereinafter, a fixing device and an image forming device according to one or more embodiments of the present invention will be described with reference to the drawings. However, the scope of the invention is not limited to the disclosed embodiments. In the following description, the same parts and constituent elements are denoted by the same reference numerals. The names thereof and the functions thereof are also the same. Therefore, description thereof will not be repeated.

[1] Schematic Configuration of Image Forming Device

FIG. 1 is a diagram schematically illustrating a configuration of an MFP 500 which is an example of an image forming device. In FIG. 1, as an example of an image forming device, an image forming device having a tandem type color image forming unit mounted thereon is illustrated.

With reference to FIG. 1, the MFP 500 includes a controller 100 and an image former 200. Typically, the image former 200 forms a color or monochrome image on a sheet P loaded in a sheet feeding cassette 1 based on image information obtained by optically reading the contents of a document to be printed by a scanner unit 800. An auto document feeder (ADF) 900 is connected to the scanner unit 800, and a document to be printed is sequentially conveyed from the ADF 900.

More specifically, the image former 200 includes process units 30C, 30M, 30Y, and 30K (hereinafter, also referred to generically as "process units 30") for four colors of cyan (C), magenta (M), yellow (Y), and black (K), respectively. The process units 30 of the respective colors are arranged along a movement direction of a transfer belt 8, and sequentially form toner images of corresponding colors on the transfer belt 8.

The process units 30C, 30M, 30Y, and 30K include primary transfer rollers 10C, 10M, 10Y, and 10K (hereinafter, also referred to generically as "primary transfer rollers 10"), photoreceptors 11C, 11M, 11Y and 11K (hereinafter, also referred to generically as "photoreceptors 11"), developing rollers 12C, 12M, 12Y and 12K (hereinafter, also referred to generically as "developing rollers 12"), print heads 13C, 13M, 13Y, and 13K (hereinafter, also referred to generically as "print heads 13"), chargers 14C, 14M, 14Y, and 14K (hereinafter, also referred to generically as "chargers 14"), and toner units 15C, 15M, 15Y, and 15K (hereinafter, also referred to generically as "toner units 15"), respectively.

When receiving a print request in response to an operation of a user on an operation panel 300 or the like, each of the process units 30 forms a toner image of each of colors constituting an image to be printed on the photoreceptor 11, and transfers the formed toner image of each of the colors onto the transfer belt 8 at the same timing as another process unit 30. At this time, the primary transfer roller 10 moves a toner image on the corresponding photoreceptor 11 to the transfer belt 8.

In each of the process units, the charger 14 charges a surface of the rotating photoreceptor 11, and exposes the surface of the photoreceptor 11 to light according to image information to be printed by the print head 13. As a result, an electrostatic latent image representing a toner image to be formed is formed on the surface of the photoreceptor 11. Thereafter, the developing roller 12 supplies a toner of the toner unit 15 to the surface of the photoreceptor 11. As a result, an electrostatic latent image is developed as a toner image on the photoreceptor 11. Thereafter, the primary transfer roller 10 sequentially transfers the toner image developed on the surface of each of the photoreceptors 11 onto the transfer belt 8 rotated by a driving motor 9. As a result, the toner images of the respective colors are superimposed, and a toner image to be transferred is formed on the sheet P.

The image former 200 includes a density sensor 31 for detecting a toner density on the transfer belt 8 in order to stabilize the density of a toner image to be printed.

As image stabilization control using the density sensor 31, several printed patches for detecting a toner density are formed on the transfer belt 8 by changing a development output of a developing apparatus and changing a toner density. The image former 200 can obtain a stable toner density at all times during printing by detecting a toner density using the density sensor 31 and feeding back the toner density to a development output of the developing apparatus depending on the result. For example, in a case where a main switch of the device main body is turned on, in a case where a toner cartridge is exchanged, or in a case where a predetermined number of sheets are printed, image stabilization control can be executed.

The image former 200 includes the sheet feeding cassette 1. In the sheet feeding cassette 1, a sheet feeding roller 1A takes out the sheet P loaded in the sheet feeding cassette 1. The sheet P thus taken out is conveyed along a conveying path 3 by a conveying roller 74 or the like. The conveying roller 74 makes the sheet P stand by at a position where the sheet P has reached a timing sensor. Thereafter, the conveying roller 74 conveys the sheet P to a secondary transfer roller 5 at the same timing as timing when the toner image formed on the transfer belt 8 reaches the secondary transfer roller 5.

The toner image on the transfer belt 8 is transferred onto the sheet P by the secondary transfer roller 5 and a facing roller 6. Typically, by applying a predetermined potential (for example, about +2000 V) corresponding to a charge of the toner image to the secondary transfer roller 5, a force to electrically attract the toner image on the transfer belt 8 to the secondary transfer roller 5 is generated. As a result, the toner image is transferred onto the sheet P.

Furthermore, the toner image transferred onto the sheet P is processed in a fixing device (fixing unit 60 in FIG. 2 described later) including a fixing belt 605, a pressurizing roller 609, or the like, and is thereby fixed to the sheet P The sheet P to which the toner image has been fixed is output to a sheet discharge tray. As a result, a series of print processes are completed. In the MFP 500, the fixing belt 605 is an example of a fixing member, and the pressurizing roller 609 is an example of a pressurizing member.

A smoothness sensor 66 is disposed along the conveying path 3. The smoothness sensor 66 detects the smoothness of a surface of the sheet P on the conveying path 3, and outputs the smoothness to the controller 100. The MFP 500 may include any type of sensor including an air leakage type sensor as the smoothness sensor 66.

[2] Configuration of Fixing Unit and the Vicinity Thereof

Figure 2:
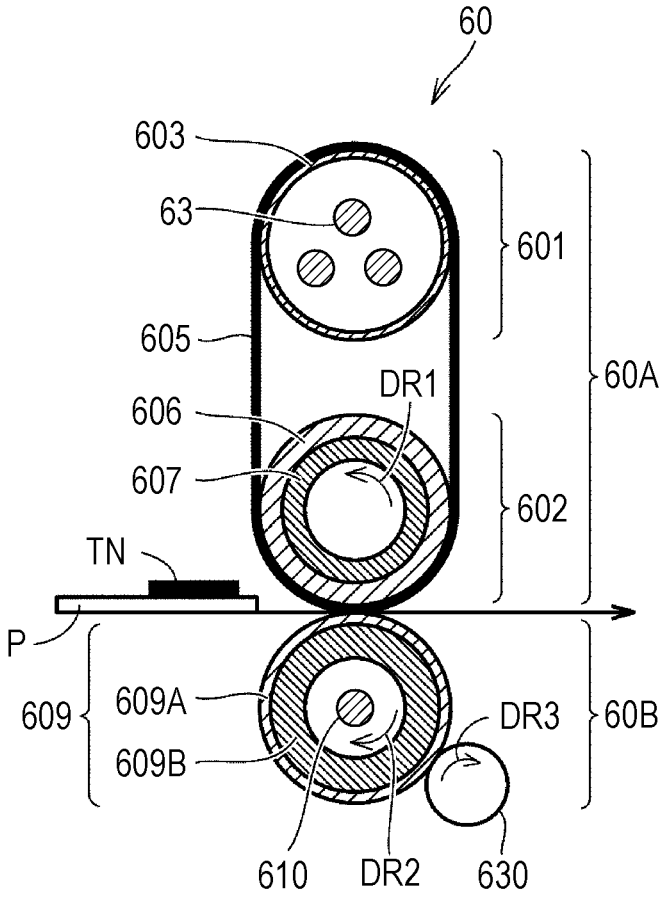
FIG. 2 is a diagram schematically illustrating a configuration of a fixing unit of the MFP in FIG. 1 and the vicinity thereof.

FIG. 2 is a diagram schematically illustrating a configuration of the fixing unit 60 of the MFP 500 in FIG. 1 and the vicinity thereof. As illustrated in FIG. 2, the fixing unit 60 includes a heating unit 60A and a pressurizing unit 60B. The heating unit 60A includes a heating roller 601 and a fixing roller 602. The fixing belt 605 is stretched over the heating roller 601 and the fixing roller 602. For ease of explanation. FIG. 2 illustrates an arrangement of the heating roller 601 and the fixing roller 602 rotated clockwise by 90 degrees with respect to FIG. 1.

The heating roller 601 houses a heater 63 therein. The heater 63 heats a surface of the fixing belt 605. A target temperature for heating is, for example, 80 to 250° C. On the surface of the fixing belt 605, a temperature sensor (not illustrated in FIG. 1) ("temperature sensor 64" in FIG. 3) is disposed. In the MFP 500, the temperature of the fixing belt 605 is monitored by the temperature sensor, and this temperature is fed back to a temperature control circuit (not illustrated). As a result, the fixing belt 605 is controlled to a predetermined temperature.

In the fixing roller 602, a cylindrical metal substrate is coated with a rubber 603. The rubber has heat resistance. A material of the rubber is, for example, a silicone rubber or a fluorocarbon rubber. The rubber has a hardness of about 5 degrees to 50 degrees. The rubber has a thickness of, for example, about 1 mm to 50 mm. In order to increase releasability of a surface of the rubber, a material for coating the cylindrical substrate of the fixing roller 602 may be a fluorine-based resin or the like.

For example, the fixing belt 605 is manufactured by coating a substrate formed of a metal, a resin, or the like with a rubber layer and further disposing a release layer on a surface of the rubber layer. In a case where the substrate is formed of a resin, the resin is preferably a resin having high heat resistance, such as polyimide. The rubber layer is preferably formed of a silicone rubber or a fluorocarbon rubber having high heat resistance. The rubber layer has a thickness of, for example, about 0.1 mm to 5 mm. The rubber has a hardness of, for example, about 5 degrees to 50 degrees. The release layer is formed of a fluorine-based resin such as a perfluoroalkoxy fluorine resin (PFA) or polytetrafluoroethylene (PTFA).

The fixing belt 605 preferably has an MD-1 hardness (type C) of 85° or more and 95° or less. The MD-1 hardness of less than 85° increases a contact area with a boundary surface to an uneven portion to increase a possibility of occurrence of image disturbance. Furthermore, the MD-1 hardness of less than 85° may deteriorate durability of the fixing belt 605. The MD-1 hardness of more than 95° decreases a contact area with a protruded portion and may deteriorate a fixing strength.

The pressurizing unit 60B is mainly formed by the pressurizing roller 609. In the pressurizing roller 609, a cylindrical metal substrate 609A is coated with a rubber 609B. The rubber 609B is a rubber having high heat resistance, such as a silicone-based rubber or a fluorine-based rubber. The rubber 609B has a thickness of, for example, about 0.1 mm to 20 mm. The rubber 609B has a hardness of, for example, about 5 degrees to 50 degrees. A release layer is preferably disposed on a surface of the rubber 609B.

In order to quickly heat the pressurizing unit 60B, a heat source (heater) may be installed inside the pressurizing roller 609.

Figure 3:
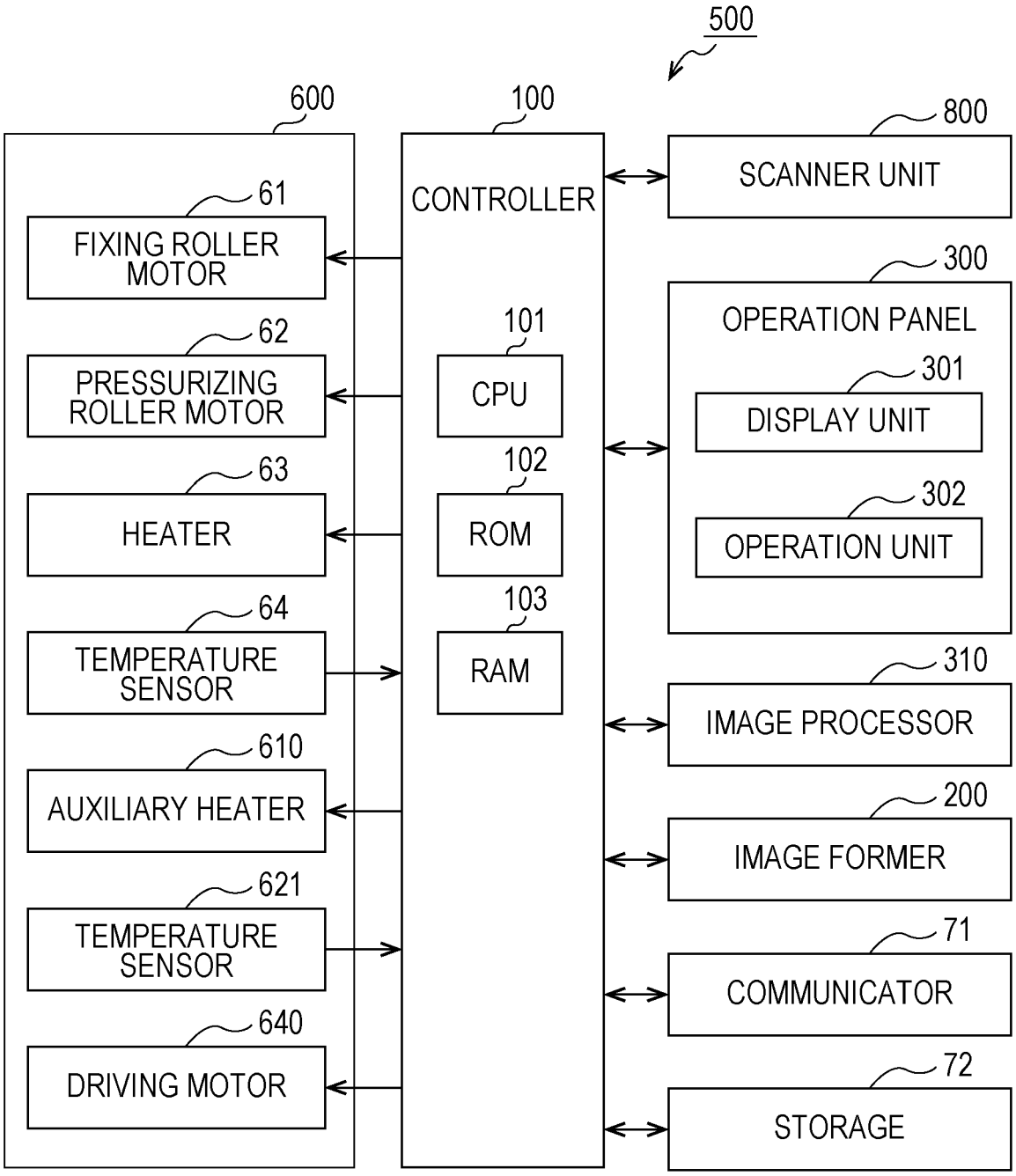
FIG. 3 is a diagram schematically illustrating a hardware configuration of the MFP.

As illustrated in FIG. 3 described later, the fixing unit 60 includes a fixing roller motor 61 and a pressurizing roller motor 62. The fixing roller motor 61 rotationally drives the fixing roller 602. As the fixing roller motor 61, for example, a servo motor is mounted. An arrow DR1 indicates a direction in which the fixing roller 602 rotates.

The pressurizing roller motor 62 rotationally drives the pressurizing roller 609. As the pressurizing roller motor 62, for example, a pulse motor is mounted. An arrow DR2 indicates a direction in which the pressurizing roller 609 rotates.

The fixing belt 605 is in contact with the pressurizing roller 609. A portion where the fixing belt 605 and the pressurizing roller 609 are in contact with each other constitutes a part of the conveying path 3 of the sheet P. In this portion, an image formed on the sheet P by a toner TN (hereinafter also referred to as "toner image" appropriately) is fixed. Here, a portion where the fixing belt 605 and the pressurizing roller 609 are in contact with each other is also referred to as a "nip portion".

In the MFP 500, an auxiliary heater 610 is housed in the pressurizing roller 609. The auxiliary heater 610 heats the pressurizing roller 609. The auxiliary heater 610 is formed by, for example, one or more glass tube heaters. The pressurizing roller 609 is heated by the auxiliary heater 610, and the sheet P comes into contact with the pressurizing roller 609 (or passes through the vicinity of the pressurizing roller 609). As a result, on the paper P, heat received from the fixing belt 605 is kept warm. As a result, the degree of temperature drop on the sheet P becomes gentle.

The MFP 500 further includes a cooling member 630. The cooling member 630 is formed by, for example, a roller in contact with the pressurizing roller 609, and rotates according to rotation of the pressurizing roller 609. An arrow DR3 in FIG. 2 represents a rotation direction of the cooling member 630. The cooling member 630 is formed by, for example, steel, an aluminum alloy, or stainless steel. The cooling member 630 is in contact with the pressurizing roller 609 to cool the pressurizing roller 609. The MFP 500 adjusts a heating temperature of the pressurizing roller 609. The MFP 500 may include a member that adjusts a distance between the pressurizing roller 609 and the cooling member 630. The MFP 500 may perform control such that the ember brings the pressurizing roller 609 and the cooling member 630 into contact with each other only when the pressurizing roller 609 needs to be cooled.

[3] Hardware Configuration of MFP

FIG. 3 is a diagram schematically illustrating a hardware configuration of the MFP 500.

As illustrated in FIG. 3, the controller 100 includes a central processing unit (CPU) 101, a read only memory (ROM) 102, and a random access memory (RAM) 103. The CPU 101 reads a program corresponding to processing contents from the ROM 102, develops the program in the RAM 103, and cooperates with the developed program to control an operation of each block of the MFP 500. At this time, the CPU 101 refers to various kinds of data stored in a storage 72. The storage 72 is formed by, for example, a nonvolatile semiconductor memory (so-called flash memory) and/or a hard disk drive.

The controller 100 exchanges various kinds of data with an external device (for example, a personal computer) connected to a communication network such as a local area network (LAN) or a wide area network (WAN) via a communicator 71. For example, the controller 100 receives image data transmitted from an external device, and forms an image on the sheet P based on the image data. The communicator 71 is formed by a communication control card such as a LAN card.

The scanner unit 800 includes an ADF 900 (refer to FIG. 1) and a scanner. The ADF 900 conveys a document placed on a document tray with a conveyance mechanism and sends the document to a document image scanning device 12. The scanner can read images of a large number of documents D (including both surfaces) placed on the document tray in succession at once.

The scanner of the scanner unit 800 optically scans a document conveyed onto a contact glass from the ADF 900 or a document placed on the contact glass, forms an image of reflected light from the document on a light receiving surface of a charge coupled device (CCD) sensor, and reads the document image. The scanner unit 800 generates image data based on the reading result by the scanner. This image data is subjected to a predetermined image process in an image processor 310.

An operation panel 300 is implemented by, for example, a unit with a touch panel, and functions as a display unit 301 and an operation unit 302. The display unit 301 is implemented by, for example, a liquid crystal display (LCD), and displays various operation screens, an image status, operation conditions of functions, and the like according to a display control signal input from the controller 100. The operation unit 302 is implemented by various operation keys such as a numeric key and a start key, and a touch sensor in a touch panel. The operation unit 302 accepts various input operations by a user and outputs an operation signal to the controller 100.

The image processor 310 includes, for example, a circuit that performs a digital image process depending on initial setting or user setting for image data. For example, wider control of the controller 100, the image processor 310 performs tone correction based on tone correction data (tone correction table), and executes various kinds of processes (including various kinds of correction processes such as tone correction, color correction, and shading correction, and a compression process) on input image data. The controller 100 controls the image former 200 based on image data that has been subjected to these processes.

The fixing unit 60 further includes a driving motor 640 for adjusting a distance between the pressurizing roller 609 and the fixing belt 605. The driving motor 640 displaces the pressurizing roller 609, for example.

In the fixing unit 60, the controller 100 controls the fixing roller motor 61, the pressurizing roller motor 62, the driving motor 640, the heater 63, and the auxiliary heater 610.

The temperature sensor 64 is disposed on a surface of the fixing belt 605. A temperature sensor 621 is disposed on a surface of the pressurizing roller 609. Each of the temperature sensor 64 and the temperature sensor 621 outputs a detection output thereof to the controller 100.

[4] Preparation of Toner

A method for preparing a toner used for image formation in the MFP 500 will be described.

[4-1] Base Particles of Toner

The toner used in the MFP 500 contains a binder resin and a metal element. The toner may contain a release agent (wax). Each of these will be described below.

[4-1-1] Binder Resin

The binder resin is not particularly limited, and various known resins can be used. Examples thereof include an amorphous resin (a vinyl resin, an amorphous polyester resin, or the like) and a crystalline resin (a crystalline polyester resin or the like).

[Amorphous Resin]

Examples of the amorphous resin which is an example of the binder resin include a vinyl resin and an amorphous polyester resin. The vinyl resin is a polymer of a vinyl monomer. Specific examples of the vinyl resin include a styrene resin, an acrylic resin, and a styrene-acrylic resin.

Toner particles preferably contain a styrene-acrylic resin as the binder resin, and the content of the styrene-acrylic resin in the toner particles is preferably 5% by mass or more from a viewpoint of obtaining excellent heat-resistant storage stability. The content of the styrene-acrylic resin in the toner particles is preferably 80% by mass or less from a viewpoint of achieving both heat-resistant storage stability and low-temperature fixability.

The vinyl monomer is a polymerizable monomer having a vinyl group, and can be used singly or in combination of a plurality of kinds of vinyl monomers. The following monomers are examples of the vinyl monomer. In particular, by using a polyfunctional vinyl, a polymer laving a crosslinked structure can be obtained. The styrene-acrylic resin may be a copolymer obtained by further combining a styrene-based monomer and a (meth)acrylic acid-based monomer with another vinyl monomer.

Examples of a polymerizable monomer for obtaining the styrene-acrylic resin include: a styrene-based monomer such as styrene, methylstyrene, methoxystyrene, butylstyrene, phenylstyrene, or chlorostyrene a (meth)acrylate-based monomer such as methyl (meth)acrylate, ethyl (meth)acrylate, butyl (meth)acrylate, or ethylhexyl (meth)acrylate; and a carboxylic acid-based monomer such as acrylic acid, methacrylic acid, or fumaric acid.

In particular, by using a polyfunctional vinyl, a polymer having an ionically crosslinked structure can be obtained. The styrene-acrylic resin may be a copolymer obtained by further combining a styrene-based monomer and a (meth) acrylic acid-based monomer with another vinyl monomer.

In particular, a vinyl monomer having an acid group is preferable because vinyl resins tend to be ionically crosslinked with each other, and the degree of ionic crosslinking is easily controlled by adjusting the contents of the acid group in the vinyl resins.

The acid group means an ionically dissociable group such as a carboxy group, a sulfonic acid group, or a phosphoric acid group. Examples of the vinyl monomer having a carboxy group include acrylic acid, methacrylic acid, maleic acid, itaconic acid, cinnamic acid, fumaric acid, a maleic acid monoalkyl ester, and an itaconic acid monoalkyl ester. Examples of the vinyl monomer having a sulfonic acid group include styrene sulfonic acid, allyl sulfosuccinic acid, and 2-acrylamide-2-methylpropanesulfonic acid. Examples of the vinyl monomer having a phosphoric acid group include acidophosphoxyethyl methacrylate.

The glass transition point (Tg) of the binder resin is preferably 30 to 60° C., and more preferably 35 to 50° C. With the glass transition point of the binder resin within the above range, both low-temperature fixability and heat-resistant storage stability are achieved.

The glass transition point of the binder resin is measured, for example, using "Diamond DSC" (manufactured by Perkin Elmer Co., Ltd.).

As a measuring procedure, 3.0 mg of a sample (binder resin) is enclosed in an aluminum pan, and the aluminum pan is set in a holder. An empty aluminum pan is used as a reference. As measurement conditions. Heat-cool-Heat temperature control is performed at a measurement temperature of 0 to 200° C., a temperature-rising rate of 10° C./min, and a temperature-falling rate of 10° C./min. analysis is performed based on data at the second Heat, an extension line of a base line before rise of a first endothermic peak and a tangent line indicating a maximum inclination from a rising portion of the first peak to a peak apex are drawn, and an intersection of these lines is defined as the glass transition temperature.

[Amorphous Polyester Resin]

The amorphous polyester resin which is another example of the binder resin refers to a resin exhibiting an amorphous property among polyester resins obtained by a polymerization reaction of a polyvalent carboxylic acid monomer and a polyhydric alcohol monomer.

Similarly to the crystalline polyester resin described above, the amorphous polyester resin can be synthesized by polymerizing a polyvalent carboxylic acid monomer and a polyhydric alcohol monomer using an esterification catalyst.

Examples of the polyvalent carboxylic acid monomer that can be used for synthesis of the amorphous polyester resin include phthalic acid, isophthalic acid, terephthalic acid, trimellitic acid, naphthalene-2,6-dicarboxylic acid, malonic acid, mesaconic acid, dimethyl isophthalate, fumaric acid, dodecenyl succinic acid, and 1,10-decanedicarboxylic acid. Among these monomers, dimethyl isophthalate, terephthalic acid, dodecenyl succinic acid, or trimellitic acid is preferable.

Examples of the polyhydric alcohol monomer that can be used for synthesis of the amorphous polyester resin include, as a dihydric or trihydric alcohol, ethylene glycol, propylene glycol, 1,4-butanediol, 2,3-butanediol, diethylene glycol, triethylene glycol, 1,5-pentanediol, 1,6-hexanediol, neopentyl glycol, 1,4-cyclohexanedimethanol, dipropylene glycol, polyethylene glycol, polypropylene glycol, an ethylene oxide adduct of bisphenol A (BPA-EO), a propylene oxide adduct of bisphenol A (BPA-PO), glycerin, sorbitol, 1,4-sorbitan, and trimethylolpropane. Among these alcohols, an ethylene oxide adduct of bisphenol A and a propylene oxide adduct of bisphenol A are preferable.

In particular, the amorphous polyester resin preferably has a structure derived from trimellitic acid.

Such an amorphous polyester resin can form many ionically crosslinked structures. The more the ionically crosslinked structure is, the less a toner tends to melt. Therefore, by adjusting the degree of ionic crosslinking, meltability of a toner can be easily adjusted.

[Crystalline Polyester Resin]

The crystalline polyester resin which is still another example of the binder resin is, for example, a polyester resin exhibiting crystallinity among known polyester resins obtained by a polycondensation reaction between a divalent or higher carboxylic acid (polyvalent carboxylic acid) monomer and a dihydric or higher alcohol (polyhydric alcohol) monomer. A crystalline polyester resin can be adopted as the binder resin in order to provide toner particles having better low-temperature fixability.

A method for synthesizing the crystalline polyester resin is not particularly limited. In an example, the crystalline polyester resin can be formed by polymerizing (esterifying) the polyvalent carboxylic acid monomer and the polyhydric alcohol monomer using an esterification catalyst.

The polyvalent carboxylic acid monomer is a compound having two or more carboxy groups in one molecule.

Examples of the polyvalent carboxylic acid monomer that can be used for synthesis of the crystalline polyester resin include a saturated aliphatic dicarboxylic acid such as oxalic acid, malonic acid, succinic acid, adipic acid, sebacic acid, azelaic acid, n-dodecylsuccinic acid, or 1,10-decanedicarboxylic acid (dodecanedioic acid); an alicyclic dicarboxylic acid such as cyclohexanedicarboxylic acid; an aromatic dicarboxylic acid such as phthalic acid, isophthalic acid, or terephthalic acid; a trivalent or higher polyvalent carboxylic acid such as trimellitic acid or pyromellitic acid; anhydrides of these carboxylic acid compounds; and alkyl esters of these carboxylic acid compounds, having 1 to 3 carbon atoms.

These compounds may be used singly or in combination of two or more kinds thereof.

The poly hydric alcohol monomer is a compound having two or more hydroxy groups in one molecule.

Examples of the polyhydric alcohol monomer that can be used for synthesis of the crystalline polyester resin include an aliphatic diol such as 1,2-propanediol, 1,3-propanediol, 1,4-butanediol, 1,5-pentanediol, 1,6-hexanediol, 1,7-heptanediol, 1,8-octanediol, 1,9-nonanediol, neopentyl glycol, or 1,4-butenediol; and a trivalent or higher polyhydric alcohol such as glycerin, pentaerythritol, trimethylolpropane, or sorbitol.

These compounds may be used singly or in combination of two or more kinds thereof.

Examples of the esterification catalyst that can be used include an alkali metal compound of sodium or lithium; an alkaline earth metal compound of magnesium or calcium; a metal compound of aluminum, zinc, manganese, antimony, titanium, tin, zirconium, or germanium; a phosphorous acid compound; a phosphoric acid compound, and an amine compound.

The melting point (Tm) of a crystalline resin such as the crystalline polyester resin is preferably in a range of 65 to 85° C., and more preferably in a range of 70 to 80° C. from a viewpoint of achieving all of excellent low-temperature fixability, heat resistance, and hot offset resistance.

[4-1-2] Metal Element

The toner particles contain a metal element that ionically crosslinks the binder resin. The content of the metal element in the toner particles is preferably in a range of 0.05 to 0.40% by mass, more preferably in a range of 0.15 to 0.40% by mass, and still more preferably in a range of 0.15 to 0.35% by mass.

By containing the metal element within the above range, the degree of elastic recovery (described later with reference to FIG. 5) of the toner can be controlled. More specifically, in the present embodiment, by inclusion of the metal element in the toner, the binder resin in the toner is ionically crosslinked. The binder resin is ionically crosslinked. As a result, the degree of elastic recovery of the toner can be adjusted by a process condition (for example, heating temperature of the pressurizing roller 609). In the present embodiment, the degree of elastic recovery of the toner is controlled by using the toner containing the metal element and by controlling the process condition. By controlling the degree of elastic recovery of the toner, gloss of a toner image formed on the sheet P is controlled.

[4-1-3] Release Agent (Wax)

In a case where the toner contains a release agent, the release agent may be a known wax, and is not particularly limited.

More specifically, examples of the release agent that can be used include a polyolefin wax such as a polyethylene wax or a polypropylene wax; a branched chain hydrocarbon wax such as a microcrystalline wax; a long chain hydrocarbon-based wax such as a paraffin wax or a sazol wax; a dialkyl ketone-based wax such as distearyl ketone, an ester-based wax such as a carnauba wax, a montan wax, behenic acid behenate, trimethylolpropane tribehenate, pentaerythritol tetrabehenate, pentaerythritol diacetate dibehenate, glycerin tribehenate, 1,18-octadecanediol distearate, tristearyl trimellitate, or distearyl maleate; and an amide-based wax such as ethylenediamine behenylamide or trimellitic acid tristearylamide.

The content of the release agent is preferably 1 to 30 parts by mass, and more preferably 5 to 20 parts by mass relative to 100 parts by mass of the binder resin. The content ratio of the release agent within the above range makes it possible to obtain fixing separability.

[4-2] Colorant

In a case where the toner particles contain a colorant, a dye and a pigment generally known can be used as the colorant.

Examples of a colorant for obtaining a black toner include various known colorants, for example, a carbon black such as furnace black or channel black, a magnetic substance such as magnetite or ferrite, a dye, and an inorganic pigment including non-magnetic iron oxide.

As a colorant for obtaining a color toner, a known colorant such as a dye or an organic pigment can be arbitrarily used. Specific examples of the organic pigment include C.I. Pigment Red 5, C.I. Pigment Red 48:1, C.I. Pigment Red 53:1, C.I. Pigment Red 57:1, C.I. Pigment Red 81:4. C.I. Pigment Red 122. C.I. Pigment Red 139. C.I. Pigment Red 144, C.I. Pigment Red 149, C.I. Pigment Red 166, C.I. Pigment Red 177, C.I. Pigment Red 178, C.I. Pigment Red 222, C.I. Pigment Red 238. C.I. Pigment Red 269. C.I. Pigment Yellow 14, C.I. Pigment Yellow 17. C.I. Pigment Yellow 74, C.I. Pigment Yellow 93, C.I. Pigment Yellow 94, C.I. Pigment Yellow 138, C.I. Pigment Yellow 155, C.I. Pigment Yellow 180. C.I. Pigment Yellow 185. C.I. Pigment Orange 31, C.I. Pigment Orange 43, C.I. Pigment Blue 15:3. C.I. Pigment Blue 60, and C.I. Pigment Blue 76. Examples of the dye include C.I. Solvent Red 1, C.I. Solvent Red 49. C.I. Solvent Red 52, C.I. Solvent Red 58, C.I. Solvent Red 68, C.I. Solvent Red 11, C.I. Solvent Red 122, C.I. Solvent Yellow 19, C.I. Solvent Yellow 44, C.I. Solvent Yellow 77, C.I. Solvent Yellow 79, C.I. Solvent Yellow 81, C.I. Solvent Yellow 82. C.I. Solvent Yellow 93, C.I. Solvent Yellow 98, C.I. Solvent Yellow 103. C.I. Solvent Yellow 104, C.I. Solvent Yellow 112, C.I. Solvent Yellow 162, C.I. Solvent Blue 25. C.I. Solvent Blue 36, C.I. Solvent Blue 69. C.I. Solvent Blue 70, C.I. Solvent Blue 93, and C.I. Solvent Blue 95.

The above-described colorants for obtaining a toner of each color may be used singly or in combination of two or more kinds thereof for each color.

The content ratio of the colorant is preferably 1 to 10 parts by mass, and more preferably 2 to 8 parts by mass relative to 100 parts by mass of the binder resin.

[4-3] Charge Control Agent

In a case where the toner particles contain a charge control agent, a known positive or negative charge control agent can be used.

More specific examples of the positive charge control agent include a nigrosine-based dye such as "Nigrosine Base EX" (manufactured by Orient Chemical Industries. Ltd.), a quaternary ammonium salt such as "quaternary ammonium salt P-51" (manufactured by Orient Chemical Industries Ltd.) or Copy Charge PX VP435 (manufactured by Hoechst Japan), an alkoxylated amine, an alkylamide, a molybdic acid chelate pigment, and an imidazole compound such as "PLZ1001" (manufactured by Shikoku Chemicals Corporation).

Examples of the negative charge control agent include a metal complex such as "Bontron S-22" (manufactured by Orient Chemical Industries, Ltd.), "Bontron S-34" (manufactured by Orient Chemical Industries, Ltd.), "Bontron E-81" (manufactured by Orient Chemical Industries Ltd.). "Bontron E-84" (manufactured by Orient Chemical Industries, Ltd.), or "Spiron Black TRH" (manufactured by Hodogaya Chemical Co., Ltd.), a thioindigo-based pigment, a quaternary ammonium salt such as "Copy Charge NX VP434" (manufactured by Hoechst Japan), a calixarene compound such as "Bontron E-89" (manufactured by Orient Chemical Industries, Ltd.), a boron compound such as "LR147" (manufactured by Japan Carlit Co., Ltd.), and a fluoride compound such as magnesium fluoride or carbon fluoride. Examples of the metal complex used as the negative charge control agent include, in addition to those described above, compounds having various structures, such as an oxycarboxylic acid metal complex, a dicarboxylic acid metal complex, an amino acid metal complex, a diketone metal complex, a diamine metal complex, an azo group-containing benzene-benzene derivative skeleton metal body, and an azo group-containing benzene-naphthalene derivative skeleton metal complex.

The content of the charge control agent is preferably 0.01 to 10 parts by mass relative to 100 parts by mass of the binder resin.

[4-4] Core-Shell Structure

The MFP 500 may use the above-described toner particles as they are as a toner, or may use a toner having a core-shell structure. In the core-shell structure, a toner particle constitutes a core particle, and a shell layer covers a surface of the core particle.

The shell layer only needs to cover at least a part of the core particle, and the core particle may be partially exposed.

The cross section of the core-shell structure can be confirmed by a known observation means such as a transmission electron microscope (TEM) or a scanning probe microscope (SPM).

In a case of the core-shell structure, the properties such as a glass transition point, a melting point, and elastic modulus can be made different between the core particle and the shell layer, and it is possible to design a toner particle according to a purpose. For example, on a surface of a core particle containing a binder resin, a colorant, a release agent, and the like and having a relatively low glass transition point (Tg), a resin having a relatively high glass transition point (Tg) is aggregated and fusion-bonded, and a shell layer can be thereby formed.

In a case of the core-shell structure, the shell layer preferably contains a polyester resin having a structure derived from trimellitic acid.

[4-5] External Additive

An external additive may be added to the toner from a viewpoint of improving fluidity, chargeability, cleaning performance, and the like.

The external additive is formed of, for example, inorganic fine particles. Examples of the inorganic fine particles include: inorganic oxide fine particles such as silica fine particles, alumina fine particles, or titanium oxide fine particles; inorganic stearic acid compound fine particles such as aluminum stearate fine particles or zinc stearate fine particles; and inorganic titanic acid compound fine particles such as strontium titanate or zinc titanate.

The above-described inorganic fine particles have been preferably surface-treated with a silane coupling agent, a titanium coupling agent, a higher fatty acid, silicone oil, or the like from viewpoints of heat-resistant storage stability and environmental stability.

The inorganic fine particles forming the external additive preferably have an average primary particle diameter of 30 n or less. Due to the above particle diameter of the external additive formed by the inorganic fine particles, the external additive is hardly released at the time of image formation of the toner. The amount of the external additive added is 0.05 to 5% by mass, and preferably 0.1 to 3% by mass in the toner.

[4-6] Developer

The toner used in the MFP 500 can be used as a magnetic or non-magnetic one-component developer, but may be used as a two-component developer by being mixed with a carrier.

In a case where the toner is used as a two-component developer, examples of the carrier include magnetic particles formed of a conventionally known material. The magnetic particles are formed of, for example, a ferromagnetic metal such as iron, an alloy of a ferromagnetic metal, aluminum, lead, and the like, or a ferromagnetic metal compound such as ferrite or magnetite, and are particularly preferably ferrite particles.

The carrier is, for example, a coated carrier obtained by coating surfaces of magnetic particles with a coating agent such as a resin, or a binder type carrier obtained by dispersing a magnetic fine powder in a binder resin.

The carrier has an average particle diameter preferably in a range of 20 to 100 pun, more preferably in a range of 25 to 80 μm in terms of a volume-based median diameter. The volume-based median diameter of the carrier can be typically measured with a laser diffraction type particle size distribution measurement device "HELOS" (manufactured by SYMPATEC Gmbh) equipped with a wet type dispersing machine.

[4-7] Average Particle Diameter of Toner Particles

The toner particles used in the MFP 500 have an average particle diameter preferably of 3 to 9 μm, more preferably of 3 to 8 μm in terms of a volume-based median diameter. For example, in a case where the toner particles are manufactured according to an emulsion aggregation method described below, the particle diameter can be controlled by the concentration of a flocculant used, the amount of an organic solvent added, fusion-bonding time, and/or the composition of a polymer.

The volume-based median diameter within the above-described range enhances transfer efficiency, thereby improves the image quality of halftone in an image formed on the sheet P. and further improves the image quality of a thin line and a dot.

The volume-based median diameter of the toner particles can be measured and calculated, for example, by using a measuring device connected to a computer system having data processing software "Software V3.51" mounted on "Multisizer 3" (manufactured by Beckman Coulter, Inc.).

Specifically, 0.02 g of a sample (toner particles) is added to 20 mL of a surfactant solution (for the purpose of dispersing the toner particles, for example, a surfactant solution obtained by diluting a neutral detergent containing a surfactant component 10 times with pure water). Thereafter, the sample to which the surfactant solution has been added is ultrasonically dispersed for one minute to prepare a toner particle dispersion. This toner particle dispersion is poured into a beaker containing "ISOTON II" (manufactured by Beckman Coulter. Inc.) in a sample stand, for example, with a pipette until a display concentration of the measuring device reaches 8%. By adjusting the concentration to the concentration range, a reproducible measurement value can be obtained. Thereafter, in the measuring device, the count number of measurement particles is set to 25000, and an aperture diameter is set to 50 μm. A range of 1 to 30 μm, which is a measurement range, is divided into 256 parts, a frequency value is calculated, and a particle diameter of 50% from a side with a larger volume accumulated fraction is specified as a volume-based median diameter of the toner particles.

[4-8] Average Circularity of Toner Particles

The toner particles used in the MFP 500 have an average circularity preferably of 0.930 to 1.000, more preferably of 0.950 to 0.995 from a viewpoint of improving transfer efficiency. The average circularity of the toner particles is measured, for example, using "FPIA-2100" (manufactured by Sysmex Corporation).

Specifically, for example, a sample (toner particles) is put into an aqueous solution containing a surfactant, and then the resulting solution is subjected to an ultrasonic dispersion process for one minute. As a result, the toner particles are dispersed in the aqueous solution. Thereafter, the resulting solution is photographed using "FPIA-2100" (manufactured by Sysmex Corporation) under measurement conditions: HPF (high magnification imaging) mode at an appropriate concentration of 3,000 to 10,000 HPF detection numbers. As a result, circularity is calculated for each of the toner particles according to the following formula (1).

$$\text{Circularity}=(\text{peripheral length of circle having the same projected area as particle image})/(\text{peripheral length of particle projected image}) \quad \text{formula (T)}$$

The average circularity is calculated, for example, by dividing a value obtained by adding the circularity of each of the toner particles by the total number of toner particles.

[4-9] Toner Storage Elastic Modulus

The toner according to an embodiment of the present invention preferably has storage elastic modulus (G'170) of $1\times10^2$ to $1\times10^3$ (Pa) at a temperature of 170° C. from viewpoints of glossiness stability and high temperature offset resistance. When a value of G'170 is smaller than $1\times10^2$ Pa, a change in glossiness with respect to a change in temperature is sharp, a change in glossiness easily occurs at a leading edge and a trailing edge of an image, a stable image cannot be obtained, and high temperature offset easily occurs. When a value of G'170 is larger than $1\times10^2$ Pa, the toner cannot be sufficiently melted, and glossiness is insufficient.

Viscoelastic properties of the toner can be measured using, for example, a viscoelasticity measuring device (rheometer) "RDA-II type" (manufactured by Rheometrics Co., Ltd.).

Measurement jig: A parallel plate having a diameter of 10 mm is used.

Measurement sample: A toner is heated and melted, and then is formed into a cylindrical sample having a diameter of about 10 mm and a height of 1.5 to 2.0 mm to be used.

Measurement frequency: Set to 6.28 radians/sec.

Setting of measurement distortion: An initial value is set to 0.1%, and measurement is performed in an automatic measurement mode.

Elongation correction of sample: Adjusted in an automatic measurement mode.

[4-10] Toner Softening Point

The softening point (Tsp) of the toner used in the MFP 500 is preferably 90 to 110° C. The softening point (Tsp) within the above range can reduce an influence of heat applied to the toner at the time of fixing. This makes it possible to form an image without imposing a burden on a colorant. Therefore, it is expected to develop wider and more stable color reproducibility.

The softening point (Tsp) of the toner can be controlled, for example, by any one of the following methods (m1) to (m3) or in combination thereof.

(m1) Adjust the kind of a polymerizable monomer to form a binder resin and a composition ratio thereof.

(m2) Adjust the molecular weight of a binder resin according to the kind of a chain transfer agent and the amount thereof added.

(m3) Adjust the kind of a wax or the like and the amount thereof added.

The softening point (Tsp) of the toner is measured using, for example, "Flow tester CFT-500" (manufactured by Shimadzu Corporation). In the measurement, the toner is formed into a columnar shape having a height of 10 mm. A measuring machine applies a pressure of $1.96\times10^6$ Pa from a plunger while heating the toner at a temperature rising rate of 6° C./min and extrudes the toner from a nozzle having a diameter of 1 mm and a length of 1 mm. As a result, the measuring machine draws a curve (softening flow curve) between plunger drop amount of the flow tester and temperature. In an example, a first outflow temperature is specified as a melt starting temperature. A temperature for the drop amount of 5 mm is specified as a softening point temperature.

[4-11] Method for Manufacturing Toner

Examples of a method for manufacturing a toner include a kneading/grinding method, an emulsion dispersion method, a suspension polymerization method, a dispersion polymerization method, an emulsion polymerization method, an emulsion polymerization aggregation method, a miniemulsion polymerization aggregation method, an encapsulation method, and another known method. Considering that it is necessary to obtain a toner having a small particle diameter in order to achieve a high image quality of an image as the method for manufacturing a toner, the emulsion polymerization aggregation method is adopted from viewpoints of manufacturing cost and manufacturing stability.

The method for manufacturing toner particles by the emulsion aggregation method is a method for forming toner particles by mixing an aqueous dispersion of binder resin particles and an aqueous dispersion of fine particles formed of a colorant to aggregate the binder resin particles and the colorant particles. Hereinafter, as an example of the method for manufacturing a toner, a method for manufacturing a toner by the emulsion aggregation method will be described.

(Step 1) Step of Preparing Dispersion of Binder Resin Particles Formed of Crystalline Resin. Amorphous Resin, or the Like For example, in a case where a crystalline polyester resin is used as the crystalline resin, the crystalline polyester resin is synthesized and dissolved or dispersed in an organic solvent to prepare an oil phase liquid. The oil phase liquid is subjected to phase transfer emulsification, and polyester resin particles are dispersed in an aqueous medium. The particle diameter of an oil droplet is controlled to a desired particle diameter. Thereafter, the organic solvent is removed, and an aqueous dispersion of the polyester resin can be thereby obtained.

The organic solvent used for the oil phase liquid preferably has a low boiling point and low solubility in water from a viewpoint of easiness of a removal process after formation of oil droplets. Specific examples of the organic solvent include methyl acetate, ethyl acetate, methyl ethyl ketone, methyl isobutyl ketone, toluene, and xylene. These compounds may be used singly or in combination of two or more kinds thereof.

The amount of the organic solvent used is usually in a range of 1 to 300 parts by mass relative to 100 parts by mass of the crystalline polyester resin.

Emulsion dispersion of the oil phase liquid can be performed using mechanical energy.

The amount of the aqueous medium used is preferably in a range of 50 to 2.000 parts by mass, aid more preferably in a range of 100 to 1000 parts by mass relative to 100 parts by mass of the oil phase liquid.

A surfactant or the like may be added to the aqueous medium for the purpose of improving dispersion stability of oil droplets.

The crystalline polyester resin particles preferably have an average particle diameter in a range of 100 to 400 nm in terms of a volume-based median diameter (D50).

The volume-based median diameter (D50) of the crystalline polyester resin particles can be measured using Microtrack UPA-150 (manufactured by Nikkiso Co., Ltd.).

In a case where a vinyl resin is used as the binder resin, an aqueous dispersion of vinyl resin particles can be prepared by a miniemulsion polymerization method. Specifically, a vinyl monomer and a water-soluble radical polymerization initiator are added to an aqueous medium containing a surfactant, and mechanical energy is applied thereto to form droplets. A radical derived from the radical polymerization initiator causes a polymerization reaction to proceed in the droplets. Note that the droplets may contain an oil-soluble polymerization initiator.

The vinyl resin particles may have a multilayer structure of two or more layers having different compositions from one another. The dispersion of vinyl resin particles having a multilayer structure can be obtained by a multi-step polymerization reaction. For example, the vinyl resin dispersion having a two-layer structure can be obtained by preparing a dispersion of vinyl resin particles by polymerizing a vinyl monomer (first stage polymerization), then further adding a polymerization initiator and a vinyl monomer, and performing polymerization (second stage polymerization).

[Surfactant]

Here, the surfactant used in the colorant fine particle dispersion or the aqueous medium used for polymerizing core binder resin fine particles will be described.

The surfactant is not particularly limited, but preferable examples thereof include an ionic surfactant such as a sulfonate (sodium dodecylbenzenesulfonate or sodium arylalkyl polyether sulfonate), a sulfate (sodium dodecyl sulfate, sodium tetradecyl sulfate, sodium pentadecyl sulfate, or sodium octyl sulfate), or a fatty acid salt (sodium oleate, sodium laurate, sodium caprate, sodium caprylate, sodium caproate, potassium stearate, or calcium oleate). A nonionic surfactant such as polyethylene oxide, polypropylene oxide, a combination of polypropylene oxide and polyethylene oxide, an ester of polyethylene glycol and a higher fatty acid, alkylphenol polyethylene oxide, an ester of a higher fatty acid and polyethylene glycol, an ester of a higher fatty acid and polypropylene oxide, or a sorbitan ester can also be used.

Hereinafter, a polymerization initiator and a chain transfer agent used in a step of polymerizing core binder resin fine particles will be described.

[Polymerization Initiator]

Example of the water-soluble polymerization initiator include a persulfate such as potassium persulfate or ammonium persulfate, azobisaminodipropane acetate, azobiscyanovaleric acid and a salt thereof, and hydrogen peroxide.

Example of the oil-soluble polymerization initiator include: an azo-based or diazo-based polymerization initiator such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, or azobisisobutyronitrile; and a peroxide-based polymerization initiator or a polymer initiator laving a peroxide in a side chain, such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl) propane, or tris-(t-butylperoxy) triazine.

[Chain Transfer Agent]

In order to adjust the molecular weight of a core binder resin to be obtained, a generally used chain transfer agent can be used. The chain transfer agent is not particularly limited, and examples thereof include: a mercaptan such as n-octyl mercaptan, n-decyl mercaptan, or tert-dodecyl mercaptan; a mercaptopropionate such as n-octyl-3-mercaptopropionate, terpinolene, and an $\alpha$-methylstyrene dimer.

(Step 2) Step of Preparing Colorant Fine Particle Dispersion

In step 2, by adding a colorant to an aqueous medium and dispersing the colorant with a dispersing machine, a dispersion of colorant fine particles in which the colorant is dispersed in a form of fine particles is prepared. Specifically, the colorant is dispersed in an aqueous medium in winch the concentration of a surfactant is equal to or higher than a critical micelle concentration (CMC). A dispersing machine used for the dispersion process is not particularly limited, but preferable examples thereof include an ultrasonic dispersing machine, a mechanical homogenizer, a pressurizing dispersing machine such as a Manton Gaulin or a pressure type homogenizer, a sand grinder, and a medium type dispersing machine such as a Getzmann mill or a diamond fine mill.

The colorant fine particles in the colorant fine particle dispersion preferably have a dispersion diameter of 40 to 200 nm in terms of a volume-based median diameter.

The volume-based median diameter of the colorant fine particles is measured under the following measurement conditions using "MICROTRAC UPA-150 (manufactured by HONEYWELL)".

Sample refractive index: 1.59

Sample specific gravity: 1.05 (in terms of spherical particles)

Solvent refractive index: 1.33

Solvent viscosity: 0.797 (30° C.), 1.002 (20° C.)

0 point adjustment

Adjustment was performed by putting deionized water into a measurement cell.

(Step 3) Aggregation/Fusion-Bonding Step

In step 3, core binder resin fine particles and colorant fine particles are aggregated and fusion-bonded in an aqueous medium to form associated particles to be core particles. In the aggregation/fusion-bonding step, internal additive fine particles such as wax fine particles and a charge control agent can be aggregated and fusion-bonded together with the core binder resin fine particles and the colorant fine particles.

Here. "salting-out/fusion-bonding" refers to a process for performing aggregation and fusion-bonding in parallel, adding an aggregation stopper to stop growth of particles when the particles grow to have desired particle diameters, and further heating the resulting product continuously in order to control the shapes of the particles, if necessary.

The salting-out/fusion-bonding method is a method in which a salting-out agent including an alkali metal salt or an alkaline earth metal salt, a trivalent salt, or the like is added to an aqueous medium containing core binder resin fine particles and colorant fine particles as a coagulant having a concentration equal to or higher than a critical aggregation concentration, and then the resulting mixture is heated to a temperature equal to or higher than the glass transition point of the core binder resin fine particles and equal to or higher than the melting peak temperature of the core binder resin fine particles and the colorant fine particles to perform salting-out and aggregation/fusion-bonding at the same time. Here, in the alkali metal salt and the alkaline earth metal salt winch are salting-out agents, examples of the alkali metal include lithium, potassium, and sodium, and examples of the alkaline earth metal include magnesium, calcium, strontium, and barium. Potassium, sodium, magnesium, calcium, and barium are preferable.

(Step 4) First Aging Step

In step 4, a process for aging associated particles by thermal energy is performed. By controlling the heating temperature in the aggregation/fusion-bonding step (step 3) and/or the heating temperature and time in the first aging step (step 4), a particle diameter can be constant (distribution can be narrow), and a surface of a core particle can be smooth and can have a uniform shape. Specifically, in the aggregation/fusion-bonding step (step 3), by setting the heating temperature to a lower temperature, progress of fusion-bonding of the core binder resin fine particles is suppressed to promote uniformization. In the first aging step (step 4), by setting the heating temperature to a lower temperature and prolonging the time, control is performed such that a surface of a core particle has a uniform shape.

(Step 5) Shell Layer Forming Step

In step 5, a shelling process for forming a particle having a core-shell structure is performed. More specifically, a dispersion of shell binder resin fine particles is added to a dispersion of core particles to aggregate and fusion-bond the shell binder resin fine particles to a surface of each of the core particles, and the surface of each of the core particles is thereby coated with the shell binder resin fine particles.

Step 5 is a preferable manufacturing condition for imparting both low-temperature fixability and heat-resistant storage stability. In a case of forming a color image, this shell layer is preferably formed in order to obtain high color reproducibility for a secondary color.

Specifically, a dispersion of shell binder resin fine particles is added while the heating temperatures of the dispersion of the core particles in the aggregation/fusion-bonding step (step 3) and the first aging step (step 4) are maintained. A surface of each of the core particles is slowly coated with the shell binder resin fine particles over several hours while heating and stirring are continued, and a particle having a core-shell structure is formed. The heating and stirring time is preferably 1 to 7 hours, and particularly preferably 3 to 5 hours.

(Step 6) Second Aging Step

Step 6 is performed at a stage when the particle having a core-shell structure has obtained a predetermined particle diameter by the shell layer forming step (step 5). More specifically, a stopper such as sodium chloride is added to stop a growth of the particles. Thereafter, heating and stirring are continued for several hours in order to fusion-bond the shell binder resin fine particles attached to the core particle. The thickness of a layer formed of the shell binder resin fine particles coating a surface of the core particle is set to 100 to 300 nm. In this way, the shell binder resin fine particles are fixed to a surface of the core particle to form a shell layer, and a rounded toner particle having a uniform shape and a core-shell structure is thereby formed.

Incidentally, in the present embodiment, as described later in description of a specific method for manufacturing a toner such as "[4-12-1] Toner (1)", in order to add a metal element to the toner, a metal compound (such as magnesium chloride) may be added to the dispersion.

(Step 7) Filtration and Cleaning Step

In step 7, first, a process for cooling the dispersion of the toner particles is performed. As a condition of the cooling process, cooling is preferably performed at a cooling rate of 1 to 20° C./min. A method for the cooling process is not particularly limited, and examples thereof include a cooling method by introducing a refrigerant from the outside of a reaction vessel and a cooling method by directly putting cold water into a reaction system.

Subsequently, the toner particles are separated from the dispersion of the toner particles cooled to a predetermined temperature by solid-liquid separation. Thereafter, a cleaning process for removing deposits such as a surfactant or a salting-out agent from the solid-liquid separated toner cake (aggregate obtained by aggregating the wet toner particles in a form of a cake) is performed. Here, examples of a method for a filtration process include a centrifugal separation method, a reduced pressure filtration method using Nutsche or the like, and a filtration method using a filter press or the like, and are not particularly limited thereto.

(Step 8) Drying Step

In step 8, a process for drying the cleaned toner cake is performed. Examples of a dryer used in step 8 include a spray dryer, a vacuum freeze dryer, and a reduced pressure dryer, and preferable examples thereof include a stationary shelf dryer, a movable shelf dryer, a fluidized bed dryer, a rotary dryer, and a stirring dryer. The moisture content of the dried toner particles is preferably 5% by mass or less, and more preferably 2% by mass or less. Incidentally, in a case where the dried toner particles are aggregated with weak inter-particle attraction, the aggregate may be disintegrated. Here, as a disintegrating device, a mechanical disintegrating device such as a jet mill, a Henschel mixer (registered trademark), a coffee mill, or a food processor can be used.

(Step 9) External Additive Processing Step

In step 9, a process for adding an external additive to the toner particles dried in the drying step (step 8) is performed. As a method for adding an external additive, for example, the external additive can be added using a mechanical mixing device such as a Henschel mixer or a coffee mill.

[4-12] Specific Examples of Manufacture of Toner

Hereinafter, specific examples of specific methods for manufacturing toners (1) to (8) referred to in the present embodiment will be described. In the following description, specific methods for manufacturing toners will be described, but the present invention is not limited thereto. Incidentally, in the following description, expressions "parts" and "%" are used, but these expressions mean "pans by mass" and "% by mass", respectively, unless otherwise specified.

[4-12-1] Toner (1)

[Dispersion of Styrene-Acrylic Resin Particles]

(First Stage Polymerization)

Into a reaction vessel equipped with a stirrer, a temperature sensor, a temperature control device, a cooling tube, and a nitrogen introducing device, an anionic surfactant obtained by dissolving 2.0 parts by mass of sodium lauryl sulfate as an anionic surfactant in 2900 parts by mass of deionized water in advance was put. While the anionic surfactant was stirred at a stirring rate of 230 rpm under a nitrogen stream, the internal temperature was raised to 80° C.

To the surfactant solution, 9.0 parts by mass of potassium persulfate (KPS) as a polymerization initiator was added, and the internal temperature was set to 78° C. Next, a monomer solution having the following composition was dropwise added over three hours. After completion of the dropwise addition, the resulting mixture was heated and stirred at 78° C. for one hour to perform polymerization (first stage polymerization), and a styrene-acrylic resin particle dispersion (I) was prepared.

520 parts by mass of styrene 260 parts by mass of n-butyl acrylate 60 parts by mass of methacrylic acid 13 parts by mass of n-octyl mercaptan (Second stage polymerization)

In a flask equipped with a stirrer, 51 parts by mass of an ester-based wax (melting point: 73° C.) as a release agent was added to a monomer solution having the following composition, and the mixture was heated to 85° C. to dissolve the wax, thus preparing a wax solution.

90 parts by mass of styrene 25 parts by mass of n-butyl acrylate 26 parts by mass of 2-ethylhexyl acrylate 10 parts by mass of methacrylic acid 5 parts by mass of n-octyl mercaptan Meanwhile, a surfactant solution obtained by dissolving 2 parts by mass of sodium lauryl sulfate as an anionic surfactant in 1100 parts by mass of deionized water was heated to 90° C. To this surfactant solution, the styrene-acrylic resin particle dispersion (I) was added in an amount of 28 parts by mass in terms of solid of styrene-acrylic resin. Thereafter, the wax solution was mixed with the resulting solution for one hour to be dispersed using a mechanical dispersing machine CLEARMIX (manufactured by M Technique Co., Ltd.) having a circulation path, thus preparing a dispersion of emulsified particles each having a dispersion particle diameter of 350 nm. To this dispersion, a polymerization initiator aqueous solution obtained by dissolving 2.5 parts by mass of potassium persulfate (KPS) as a polymerization initiator in 110 parts by mass of deionized water was added. The resulting mixture was heated and stirred at 90° C. for two hours to perform polymerization (second stage polymerization), thus preparing a styrene-acrylic resin particle dispersion (II).

Thereafter, the styrene-acrylic resin particle dispersion (11) was cooled to 30° C. to obtain a styrene-acrylic resin particle dispersion.

The styrene-acrylic resin in this dispersion had a weight average molecular weight (Mw) of 32,500 and a number average molecular weight (Mn) of 10,800.

[Crystalline Polyester Resin Particle Dispersion]

Into a 5 L reaction vessel equipped with a stirrer, a temperature sensor, a cooling tube, and a nitrogen introducing device, 320 parts by mass of sebacic aid as a polyvalent carboxylic acid and 175 parts by mass of 1,6-hexanediol as a polyhydric alcohol were put. While the resulting mixture was stirred, the internal temperature thereof was raised to 200° C. over one hour. It was confirmed that the mixture was uniformly stirred. Thereafter, $Ti(OBu)_4$ as a catalyst was put thereinto in an amount of 0.003% by mass relative to the amount of the polyvalent carboxylic acid added. The internal temperature was raised from 200° C. to 240° C. over six hours while generated water was distilled off, and a dehydrating condensation reaction was continued over six hours at a temperature of 240° C. to perform polymerization. As a result, a crystalline polyester resin was obtained. The crystalline polyester resin had a melting point (Tm) of 67.3° C. and a number average molecular weight (Mn) of 6.500.

Into a 3-liter jacketed reaction tank equipped with a condenser, a thermometer, a water dropping device, and an anchor blade (BJ-30N manufactured by Tokyo Rikakikai Co., Ltd.), 320 parts by mass of the crystalline polyester resin, 180 parts by mass of methyl ethyl ketone (solvent), and 100 parts by mass of isopropyl alcohol (solvent) were put. The resulting mixture was stirred and mixed at 100 rpm to dissolve the resin while the temperature was maintained at 70° C. in a water circulation type thermostatic chamber.

Thereafter, the stirring rotational rate was set to 150 rpm, the temperature of the water circulation type thermostatic chamber was set to 66° C., and 17 parts by mass of 10% by mass ammonia water (reagent) was added over 10 minutes. Thereafter, deionized water kept warm at 66° C. was dropwise added at a rate of 7 parts by mass/min in a total amount of 900 parts by mass to cause phase transfer, thus obtaining an emulsion.

Immediately thereafter, 800 parts by mass of the resulting emulsion and 700 parts by mass of deionized water were put into a 2-liter eggplant flask. The eggplant flask was set in an evaporator (manufactured by Tokyo Rikakikai Co., Ltd.) equipped with a vacuum control unit via a trap ball. While being rotated, the eggplant flask was warmed with a hot water bath at 60° C. The pressure in the eggplant flask was reduced to 7 kPa while attention was paid in order to avoid bumping, and the solvent was removed. When the solvent recovery amount reached 1100 parts by mass, the pressure was returned to normal pressure, and the eggplant flask was cooled with water to obtain a dispersion. The resulting dispersion had no solvent smell. The resin particles in this dispersion had a volume-based median diameter (D50) of 150 nm. Thereafter, deionized water was added, and adjustment was performed such that the solid concentration reached 20% by mass. This was used as a crystalline polyester resin dispersion.

[Amorphous Polyester Resin Particle Dispersion]

Into a 10-liter four-necked flask equipped with a nitrogen introducing tube, a dehydration tube, a stirrer, and a thermocouple, 500 parts by mass of bisphenol A propylene oxide 2 mol adduct, 120 parts by mass of terephthalic acid, 65 parts by mass of fumaric acid, 40 parts by mass of trimellitic acid, and 2 parts by mass of an esterification catalyst (tin octylate) were put. A condensation polymerization reaction was caused at 240° C. for eight hours, and the reaction was further caused at 10 kPa for one hour to obtain an amorphous polyester resin. The amorphous polyester resin had a glass transition point (Tg) of 61° C., a softening point (Tsp) of 108° C., and a weight average molecular weight (Mw) of 42,000.

Next, while the temperature of a 3-liter jacketed reaction tank equipped with a condenser, a thermometer, a water dropping device, and an anchor blade (BJ-30N manufactured by Tokyo Rikakikai Co., Ltd.) was maintained at 40° C. in a water circulation type thermostatic chamber, a mixed solvent of 180 parts by mass of ethyl acetate and 110 parts by mass of isopropyl alcohol was put into the reaction tank. Furthermore, 300 parts by mass of the amorphous polyester resin was added, and stirred at 150 rpm with a three-one motor to dissolve the resin, thus obtaining an oil phase. To this stirred oil phase, a 10% by mass ammonia aqueous solution was dropwise added in an amount of 14 parts by mass in five minutes as a dropping time, and the resulting mixture was mixed for 10 minutes. Thereafter 900 parts by mass of deionized water was dropwise added at a rate of 8 parts by mass/min to cause phase transfer, thus obtaining an emulsion.

Immediately thereafter, 800 parts by mass of the resulting emulsion and 700 parts by mass of deionized water were put into a 2-liter eggplant flask. The eggplant flask was set in an evaporator (manufactured by Tokyo Rikakikai Co., Ltd.) equipped with a vacuum control unit via a trap ball. While being rotated, the eggplant flask was warmed with a hot water bath at 60° C. The pressure in the eggplant flask was reduced to 10 kPa while attention was paid in order to avoid bumping, and the solvent was removed. When the solvent recovery amount reached 1000 parts by mass, the pressure was returned to normal pressure, and the eggplant flask was cooled with water to obtain a dispersion. The resulting dispersion had no solvent smell. The resin particles in this dispersion had a volume-based median diameter (D50) of 140 nm. Thereafter, deionized water was added such that the solid concentration became 20% by mass to obtain an amorphous polyester resin particle dispersion.

[Colorant Particle Dispersion]

95 parts by mass of sodium dodecyl sulfate was dissolved in 1600 parts by mass of deionized water by stirring, and 420 parts by mass of copper phthalocyanine (C.I. Pigment Blue 15:3) was gradually added thereto while this solution was stirred. Subsequently, the resulting solution was subjected to a dispersion process using a stirrer CLEARMIX (manufactured by M Technique Co., Ltd.) to prepare a colorant particle dispersion The colorant particles in the dispersion had an average particle diameter of 110 nm in terms of a volume-based median diameter.

[Addition of Metal Element]

Into a reaction vessel equipped with a stirrer, a temperature sensor, and a cooling tube, 260 parts by mass of the styrene-acrylic resin particle dispersion in terms of solid content and 2000 parts by mass of deionized water were put. A 5 mol/liter sodium hydroxide aqueous solution was added to adjust the pH to 10.0. Thereafter, 40 parts by mass of the colorant particle dispersion in terms of solid content was added. Next, an aqueous solution obtained by dissolving 120 parts by mass of magnesium chloride in 60 parts by mass of deionized water was added under stirring at 30° C. over 10 minutes. The resulting mixture was allowed to stand for three minutes. Thereafter, the temperature was started to be raised, and this system was heated to 80° C. over 60 minutes. A dispersion obtained by mixing 20 parts by mass of a crystalline polyester resin particle dispersion in terms of solid content and 40 parts by mass of a block polymer particle dispersion in terms of solid content was added over 30 minutes. The core particle growth reaction was continued while the temperature was maintained at 80° C.

In this state, the particle diameter of a core particle was measured with Coulter Multisizer 3 (manufactured by Coulter Beckmann Co., Ltd.). When the volume-based median diameter (D50) reached 6.0 pun, 40 parts by mass of an amorphous polyester resin particle dispersion in terms of solid content was added over 30 minutes to form a shell layer. When the supernatant of the reaction solution became transparent, an aqueous solution obtained by dissolving 190 parts by mass of sodium chloride in 760 parts by mass of deionized water was added to stop particle growth. Thereafter, the temperature was raised, and heating and stirring were performed at 95° C. to promote fusion-bonding of the particles. The average circularity of toner particles was measured (measured at the HPF detection number of 4000) using a measuring device FPIA-2100 (manufactured by Sysmex Corporation). When the average circularity reached 0.95, the temperature was lowered to 30° C. to obtain an aqueous dispersion of toner particles each having a core-shell structure.

The obtained aqueous dispersion of toner particles was subjected to solid-liquid separation with a centrifugal separator to form a wet cake of the toner particles. The wet cake was cleaned with deionized water at 35° C. with the centrifugal separator until the electric conductivity of the filtrate reached 5 μS/cm. After cleaning, the resulting product was transferred to a flash jet dryer (manufactured by Seishin Enterprise Co., Ltd.) and dried until the moisture content became 0.5% by mass.

To the dried toner particles, 1% by mass of hydrophobic silica (number average primary particle diameter=12 nm) and 0.3% by mass of hydrophobic titania (number average primary particle diameter=20 nm) were added and mixed using a Henschel mixer to obtain toner (1).

[4-12-2] Toner (2)

Toner (2) was manufactured in a similar manner to toner (1) except that the amount of magnesium chloride in toner (1) was changed from 120 parts by mass to 105 parts by mass in the manufacture of the toner particles.

[4-12-3] Toner (3)

Toner (3) was manufactured in a similar manner to toner (1) except that the amount of magnesium chloride in toner (1) was changed from 120 parts by mass to 60 parts by mass in the manufacture of the toner particles.

[4-12-4] Toner (4)

Toner (4) was manufactured in a similar manner to toner (1) except that the amount of magnesium chloride in toner (I) was changed from 120 parts by mass to 60 parts by mass and the pH after the addition of the sodium hydroxide aqueous solution was changed from 10.0 to 10.5 in the manufacture of the toner particles.

[4-12-5] Toner (5)

Toner (5) was manufactured in a similar manner to toner (1) except that 120 parts by mass of magnesium chloride in toner (1) was changed to 80 parts by mass of aluminum sulfate and the pH after the addition of the sodium hydroxide aqueous solution was changed from 10.0 to 9.5 in the manufacture of the toner particles.

[4-12-6] Toner (6)

Toner (6) was manufactured in a similar manner to toner (1) except that 120 parts by mass of magnesium chloride in toner (1) was changed to 60 parts by mass of aluminum sulfate in the manufacture of the toner particles.

[4-12-7] Toner (7)

Toner (7) was manufactured in a similar manner to toner (1) except that the amount of magnesium chloride in toner (I) was changed from 120 parts by mass to 40 parts by mass and the pH after the addition of the sodium hydroxide aqueous solution was changed from 10.0 to 10.5 in the manufacture of the toner particles.

[4-12-8] Toner (8)

Toner (8) was manufactured in a similar manner to toner (1) except that the amount of magnesium chloride in toner (1) was changed from 120 parts by mass to 130 parts by mass in the manufacture of the toner particles.

[4-13] Developers (1) to (8)

To toners (1) to (8), a ferrite carrier coated with a silicone resin and having a volume average particle diameter of 65 m was added so as to have a toner concentration of 6% by mass and mixed to obtain developers (1) to (8), respectively.

[4-14] Content of Metal Element

The content of a metal element in each of toners (1) to (8) was measured by acid decomposition: ICP-OES as follows.

(Preprocessing)

3 parts by mass of a sample (toner) was added to and dispersed in 35 parts by mass of a 0.2% by mass polyoxyethyl phenyl ether aqueous solution. This dispersion was processed with an ultrasonic homogenizer US-1200T (manufactured by Nippon Seiki Seisakusho Co., Ltd.) at 25° C. for five minutes, and the external additive was removed from a surface of the toner to obtain a sample for measurement.

100 mg of the sample was set in a closed microwave decomposing device ETHOS 1 (manufactured by Milestone General Co.) and decomposed by sulfuric acid and nitric acid. At this time, in a case where an undecomposed substance was present, a target component was eluted with hydrochloric acid, hydrofluoric acid, hydrogen peroxide, or the like. The decomposition solution was diluted with ultrapure water appropriately. An ultra-high purity reagent manufactured by Kanto Chemical Co., Ltd. was used as a reagent.

(Measurement)

The sample that had been preprocessed was set in a high frequency inductively coupled plasma emission spectrometer SPS3520UV (manufactured by SII Nano Technology Inc.), and the contents of metal elements Al and Mg contributing to ionic crosslinking of the binder resin were measured. At this time, a detection wavelength of each metal element was set as follows.

Al: 167.079 nm

Mg: 279.553 nm

Note that a calibration curve was created using a solution obtained by adding an atomic absorption standard solution of each element manufactured by Kanto Chemical Co., Inc. to a decomposition solution not containing a sample and performing adjustment so as to obtain the same acid concentration as a sample solution. FIG. 4 illustrates measurement results thereof. Note that only Mg was detected from toners (1) to (4), (7), and (8), and therefore the content of Mg is illustrated for each of toners (1) to (4), (7), and (8). Only Al was detected from toners (5) and (6), and therefore the content of Al is illustrated for each of toners (5) and (6).

[5] Elastic Recovery

Figure 5:
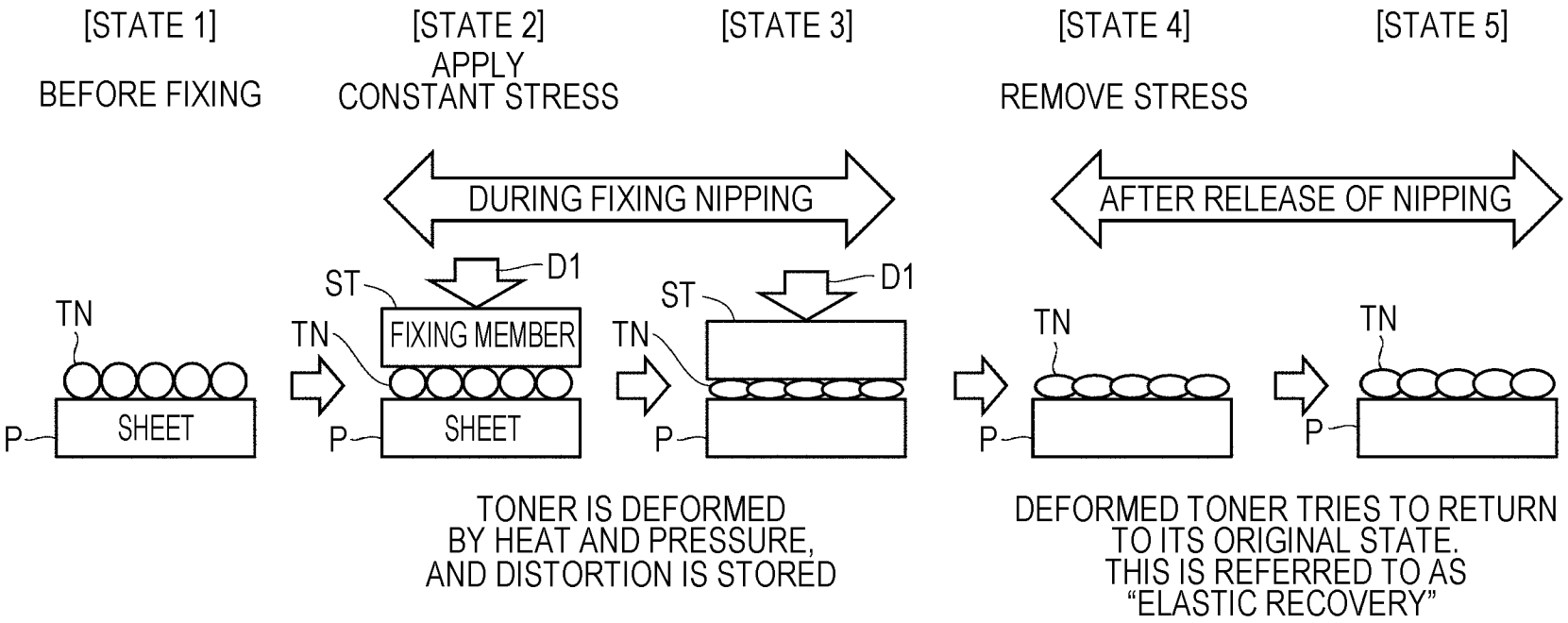
FIG. 5 is a diagram for explaining a behavior "elastic recovery"

FIG. 5 is a diagram for explaining a behavior "elastic recovery" to be considered in the present embodiment.

FIG. 5 illustrates five states (states 1 to 5) from formation of an image of the toner TN on the sheet P to fixing of the toner TN. (State 1) indicates a state before the sheet P reaches a nip portion of the fixing unit 60.

(State 2) indicates a state immediately after the sheet P reaches the nip portion. In (state 2), a force in a direction indicated by arrow D1 is applied to the toner TN by heating and pressurization by a fixing member ST (fixing belt 605 in FIG. 2). By application of the force, particles of the toner TN start to be deformed.

(State 3) indicates a state in which conveyance of the sheet P has proceeded more than (state 2), but the sheet P still remains in the nip portion. In (state 3), the toner TN is further deformed than in (state 2) by continuing heating and pressurization in the direction indicated by arrow D1.

(State 4) indicates a state in which the sheet P has passed through the nip portion. By release of pressing by the fixing member ST, in the toner TN on the sheet P, a restoring force in the opposite direction to arrow D1 is generated due to elasticity of the toner TN. As a result, the toner TN tries to return to its original state. Such a behavior of the toner TN to try to return to its original state is called "elastic recovery".

(State 5) indicates a state in which elastic recovery has proceeded more than (state 4). In (state 5), elapsed time after nipping in the nip portion is canceled is longer than in (state 4), and therefore shape recovery in the toner TN has proceeded.

[6] Component of Toner and Elastic Recovery

Figure 6:
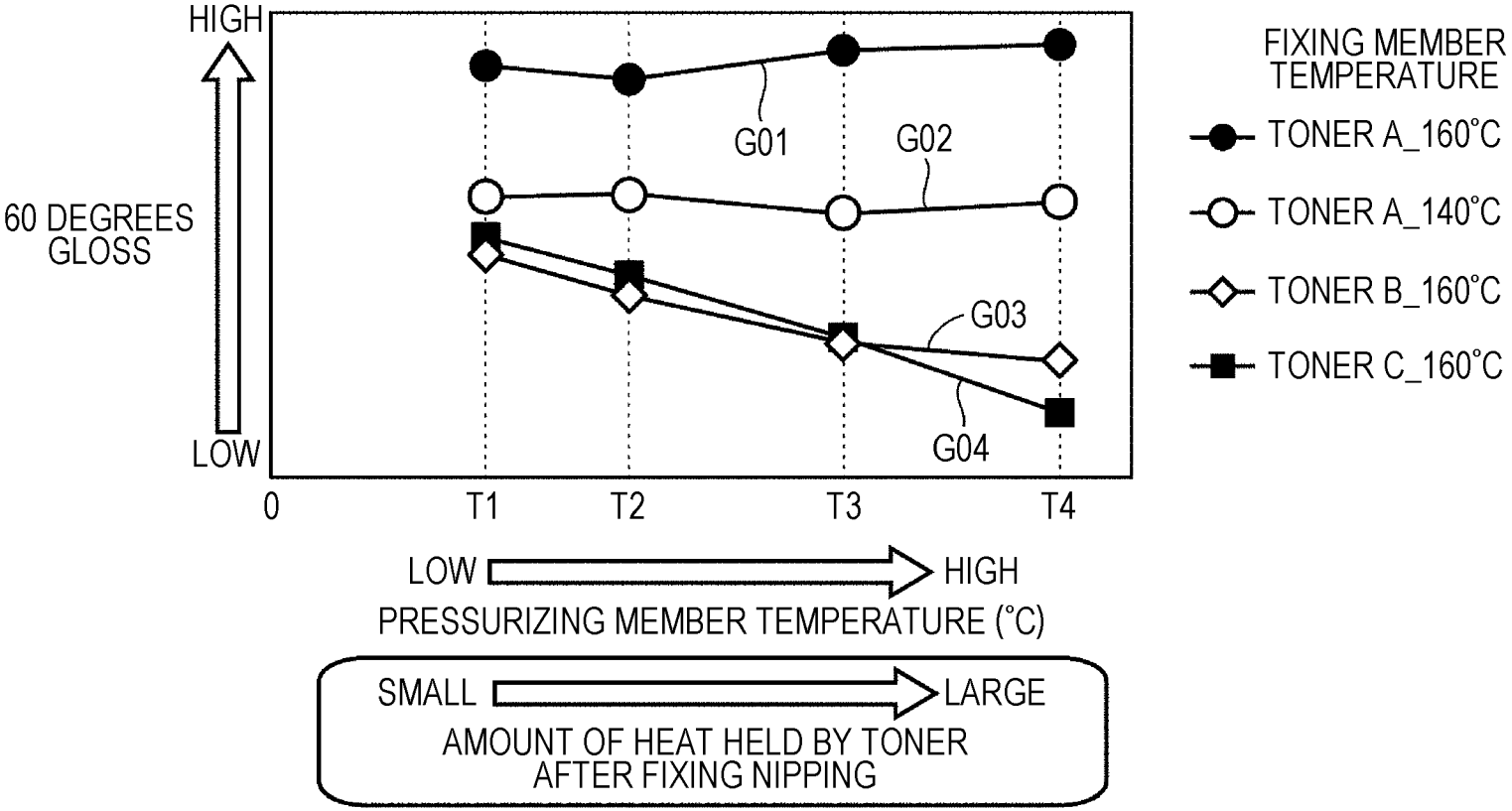
FIG. 6 is a diagram for explaining a difference in glossiness due to a difference in temperature of a pressurizing member in a nip portion.

FIG. 6 is a diagram for explaining a difference in glossiness due to a difference in temperature of a pressurizing member in the nip portion. In the graph of FIG. 6, the horizontal axis represents a heating temperature of the pressurizing member (pressurizing roller 609) in the nip portion. The vertical axis represents glossiness of a toner image formed on the sheet P that has passed through the nip portion. The graph of FIG. 6 illustrates results for three types of toners (toners A, B, and C).

More specifically, graph G01 illustrates glossiness of a toner image for toner A when the temperature of the pressurizing member is controlled to given four temperatures (T1, T2, T3, and T4) in a state where the temperature of the heating member (fixing belt 605) is controlled to 160° C.

Graph G02 illustrates glossiness of a toner image for toner A when the temperature of the pressurizing member is controlled to the above four temperatures (T1, T2. T3, and T4) in a state where the temperature of the heating member is controlled to 140° C.

Graph G03 illustrates glossiness of a toner image for toner B when the temperature of the pressurizing member is controlled to the above four temperatures (T1, T2. T3, and T4) in a state where the temperature of the heating member is controlled to 160° C.

Graph G04 illustrates glossiness of a toner image for toner C when the temperature of the pressurizing member is controlled to the above four temperatures (T1, T2, T3, and T4) in a state where the temperature of the heating member is controlled to 160° C.

In graph G02, glossiness is low regardless of the temperature of the pressurizing member as compared with graph G01. In graph G02, a fixing temperature is low. As a result, it is considered that in graph G02, toner meltability was lowered (toner was not so much melted) due to the low fixing temperature to reduce glossiness.

In graphs G03 and G04, a behavior when the temperature of the pressurizing member has changed is different as compared with graph GO 1. More specifically, in graph GO 1, glossiness is not largely affected even by a change in temperature of the pressurizing member, whereas in graphs G03 and G04, glossiness is reduced as the temperature of the pressurizing member rises.

As the temperature of the pressurizing member is higher, the temperature drop of a toner that has passed through the nip portion is further delayed. As a result, it is assumed that elastic recovery tends to occur before the temperature is lowered to a given temperature.

Here, each of toners B and C contains a metal element (magnesium, aluminum, or the like) that constitutes an ionically crosslinked structure with a toner resin, whereas toner A does not contain such a metal element. As a result, in a case where a toner containing a metal element that constitutes an ionically crosslinked structure with a toner resin is used, delay in temperature drop of a toner that has passed through the nip portion contributes more largely to occurrence of elastic recovery than in a case where a toner not containing such a metal element is used. That is, in a case where the former toner is used, delay in temperature drop contributes more largely to occurrence of elastic recovery than in a case where the latter toner is used. Therefore, in a case where toner B or C is used, the degree of reduction in glossiness when the control temperature of the pressurizing member rises is larger than in a case where toner A is used.

[7] Outline of Control

The CPU 101 of the MFP 500 can access information that associates gloss of an image to be formed with a process condition (hereinafter also referred to as "related information"). The process condition includes the temperature of the pressurizing roller 609 and the nipping pressure of the nip portion (pressure at which the sheet P is nipped by the fixing belt 605 and the pressurizing roller 609). When receiving setting of gloss, the CPU 101 acquires a process condition corresponding to the set gloss from the related information and controls the MFP 500 according to the acquired process condition.

In an example, the higher the degree of gloss to be set is, the lower the set temperature of the pressurizing roller 609 in the process condition is. Incidentally, the lower the set temperature of the pressurizing roller 609 is, the higher the rate of temperature drop of the toner TN heated by the fixing belt 605 is.

In another example, the higher the degree of gloss to be set is, the lower the nipping pressure of the nip portion under process condition is. Incidentally, the lower the nipping pressure is, the higher the rate of temperature drop of the toner TN heated by the fixing belt 605 is.

Here, a relationship between the rate of temperature drop of the toner TN and the degree of gloss of an image to be formed will be described. In a case where the rate of temperature drop of the toner TN is low, the degree of elastic recovery in the toner TN on a sheet that has passed through the nip portion is relatively small. That is, before elastic recovery sufficiently occurs, the temperature drop of the toner TN is completed. Therefore, in a case where the rate of temperature drop of the toner TN is low, the degree of elastic recovery is small, and this increases the degree of gloss of a formed image.

The process condition acquired by the CPU 101 corresponding to setting of the degree of gloss may include only one of the temperature of the pressurizing roller 609 and the nipping pressure of the nip portion, or may include both thereof.

[8] Flow of Process

Figure 7:
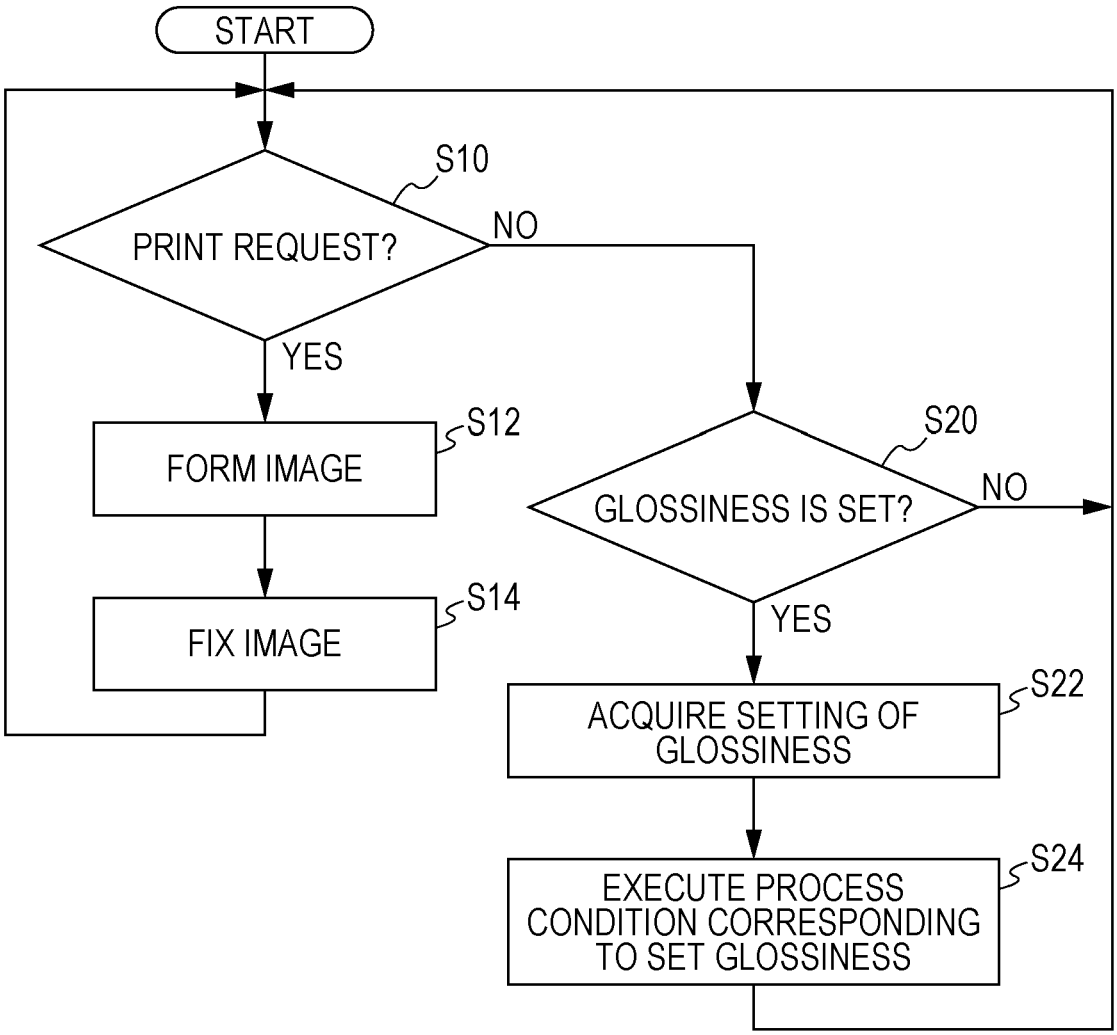
FIG. 7 is a flowchart of an example of a process executed by a CPU for printing a sheet in the MFP.

FIG. 7 is a flowchart of an example of a process executed by the CPU 101 for printing a sheet in the MFP 500. The process illustrated in FIG. 7 is implemented, for example, by execution of a given program by the CPU 101. Hereinafter, with reference to FIG. 7, a flow of the process will be described.

In step S10, the CPU 101 judges whether or not a print request (for example, input of instruction to start a print job) has been made. If the CPU 101 judges that the instruction has been given, the CPU 101 advances control to step S12 (YES in step S10), otherwise advances control to step S20 (NO in step S10). Incidentally, in a case where the instruction to start printing includes setting of glossiness, the CPU 101 may advance control to step S22, may execute control in steps S22 and S24, and then may advance control to step S12.

In step S12, the CPU 101 controls process units 30C, 30M, 30Y, and 30K to form an image on the sheet P.

In step S14, the CPU 101 controls the fixing unit 60 to fix the image formed on the sheet P with the fixing unit 60.

In step S20, the CPU 101 judges whether or not the CPU 101 has accepted setting of glossiness. The MFP 500 may set glossiness for each print request, or may set glossiness as default setting. In step S20, presence or absence of setting of glossiness is judged as default setting. If the CPU 101 judges that setting of glossiness has been requested, the CPU 101 advances control to step S22 (YES in step S20), otherwise returns control to step S10 (NO in step S20). Incidentally, as described above, in a case where the print request accepted in step S10 includes setting of glossiness, the CPU 101 may advance control to step S22.

In step S22, the CPU 101 acquires setting of glossiness.

In step S24, the CPU 101 acquires a process condition corresponding to setting acquired in step S22, and implements control according to the condition. An example of the process condition is a control temperature of the pressurizing member (pressurizing roller 609). Another example is a pressure at which the sheet P is nipped by the nip portion. For example, the CPU 101 adjusts a distance between the fixing belt 605 and the pressurizing roller 609 by controlling the driving motor 640, and thereby controls the nipping pressure in the nip portion.

After control in step S24, the CPU 101 executes image formation on the sheet P and fixation of the image in response to a print request. As a result, a printed matter on which an image has been formed is generated in an environment in accordance with the process condition.

[9] Example

FIG. 8 is a diagram illustrating a specific example of gloss of a toner image of a printed matter generated under each of nine conditions.

Examples 1 to 9 illustrated in FIG. 8 represent results of image formation performed by remodeling a commercially available color copying machine bizhub PRO C6500 (manufactured by Konica Minolta Japan, Inc.) as the MFP 500 such that a process condition can be clanged. As a toner image, a solid image having a toner adhesion amount of 8.5 g/m$^2$ was formed on OK top coat+128 g/m$^2$ (manufactured by Oji Paper Co., Ltd.). A fixing process was performed at a fixing rate of 300 mm/sec.

The example in FIG. 8 includes, as a condition, a toner type, a metal element, and a process condition. The toner type represents any one of the above toners (1) to (8). The metal element represents an element that constitutes an ionically crosslinked structure with a toner resin and represents magnesium (Mg) or aluminum (Al). The process condition includes a fixing member temperature (control temperature of the fixing belt 605), a pressurizing member temperature (control temperature of the pressurizing roller 605), and a nipping pressure of the nip portion.

For example, in Example 1, the toner (1) was used as the toner type. Toner (1) contains 0.40/by mass of magnesium as a metal element. FIG. 8 illustrates results under each of three process conditions under a condition of Example 1. The first process condition includes a fixing member temperature of 160° C., a pressurizing member temperature of 30° C., and a nipping pressure of 200 kPa. The second process condition is different from the first process condition only in pressurizing member temperature and includes a pressurizing member temperature of 60° C. The third process condition is different from the first process condition only in pressurizing member temperature and includes a pressurizing member temperature of 90° C.

The example of FIG. 8 includes gloss of a toner image and a fixing strength of a toner as evaluation results. Gloss represents gloss at an incident angle of 60 degrees, measured using a gloss meter GM-268PLUS (manufactured by Konica Minolta Japan. Inc.). The fixing strength represents rank evaluation in three stages (⊙: Image density residual ratio is 90% or more/○: Image density residual ratio is 80% or more and less than 90%/Δ: Image density residual ratio is less than 80%) obtained by rubbing a toner image formed on the sheet P twice with an eraser (sand eraser "LION 26111" manufactured by Lion Office Co., Ltd.) at a pressing load of 1 kgf and measuring a residual ratio of an image density with "X-Rite model 404" manufactured by X-Rite Inc.

In Example 1, "○" was maintained as the fixing strength at any pressurizing member temperature.

Regarding gloss, the higher the pressurizing member temperature was, the lower the glossiness was. This tendency was also observed in Examples 2 to 7. This is presumed to be due to a fact that as the pressurizing member temperature increased, the temperature of a toner was more gently lowered after fixing by the nip portion, thereby increasing the degree of elastic recovery.

When Example 1, Example 8, and Example 9 are compared with one another, in order of Example 9, Example 1, and Example 8 in which the content of a metal element descends, glossiness increases at each pressurizing member temperature. That is, the higher the content of the metal element is, the lower the glossiness is. This is presumed to be due to a fact that the degree of construction of an ionically crosslinked structure between a toner resin and a metal was increased by an increase in the content of the metal element, and the degree of elastic recovery was thereby increased.

Note that the higher the content of the metal element was, the lower the glossiness was also in Examples 2 and 4.

Here, in Example 9, although gloss of a toner image was reduced, the fixing strength was also reduced (fixing strength: evaluation "Δ"). As a cause of the reduction in fixing strength, it is estimated that as the content of the metal element in a toner increases, the viscoelasticity of the toner increases, and this makes it difficult for the toner to deform at the time of fixing. Therefore, the content of the metal element in the toner is preferably about 0.05 to 0.40% by mass, more preferably 0.15 to 0.40% by mass, and still more preferably 0.15 to 0.35% by mass.

The nipping pressure was adjusted In Example 3, whereas the nipping pressure was not adjusted in Example 2. As compared with Example 2, in Example 3, the reduction in nipping pressure with a rise in pressurizing member temperature reduces glossiness more largely. From this fact, it is estimated that even the reduction in nipping pressure promotes elastic recovery of a toner after nipping, and thereby reduces glossiness of a toner image.

Each of the toners in Examples 1 to 5, 8, and 9 contains magnesium (Mg), whereas each of the toners in Examples 6 and 7 contains aluminum (Al). As illustrated in Examples 6 and 7, even in a case where a toner contains aluminum, a rise in pressurizing member temperature reduces glossiness of a toner image. When Examples 6 and 7 are compared with each other, the degree of reduction in glossiness of a toner image is improved as the content of aluminum increases. That is, even in a case where a toner contains aluminum as a metal element instead of magnesium, a similar effect is achieved.

In the present disclosure, by adjusting the process condition and the like, the rate of temperature drop of a toner in a toner image formed on the sheet P after nipping is adjusted, and gloss of the toner image formed on the sheet P is thereby adjusted. This concept can also be realized as adjustment of a process condition according to the thickness of the sheet P itself. In an example, in order to obtain the same glossiness, the control temperature of the pressurizing member (pressurizing roller 609) can be set higher as the sheet P is thicker. A reason for this is as follows. That is, a temperature difference between a front surface and a back surface of the sheet P is larger as the sheet P is thicker, therefore the temperature of a toner in a toner image formed on a surface of the sheet P is transmitted to the back surface, and the rate of temperature drop of the toner is thereby increased.

According to an embodiment of the present disclosure, when setting of glossiness of a toner image is acquired as print setting, a heating temperature of a pressurizing member is controlled according to the setting. As a result, the glossiness of the toner image is controlled while avoiding an increase in size of a device and suppressing the consumption amount of energy.

Although embodiments of the present invention have been described and illustrated in detail, the disclosed embodiments are made for purposes of illustration and example only and not limitation. The scope of the present invention should be interpreted by terms of the appended claims. In addition, the inventions described in the embodiment and modified examples thereof are intended to be implemented either singly or in combination, if possible.

What is claimed is:

1. A fixing device comprising:

a fixing member that heats a toner image formed on a recording sheet in order to fix the toner image on the recording sheet;

a pressurizing member that nips the recording sheet together with the fixing member to pressurize the toner image on the recording sheet;

a heater that heats the pressurizing member; and a hardware processor that controls a heating temperature of the pressurizing member by the heater, wherein the hardware processor acquires a setting of glossiness of the toner image to be formed on the recording sheet, and based on the acquired setting of the glossiness, the hardware processor controls the heating temperature of the pressurizing member, wherein the hardware processor controls the heating temperature in accordance with a thickness of the recording sheet and the glossiness in the setting, and wherein toner particles constituting the toner image contain 0.05 to 0.40% of a metal element that ionically crosslinks a binder resin.

2. The fixing device according to claim 1, further comprising a cooling member that cools the pressurizing member.

3. The fixing device according to claim 1, wherein the pressurizing member has a belt shape.

4. The fixing device according to claim 1, wherein the hardware processor adjusts a pressure at which the fixing member and the pressurizing member nip the recording sheet in accordance with the glossiness in the setting.

5. A fixing device comprising:

a fixing member that heats a toner image formed on a recording sheet in order to fix the toner image on the recording sheet;

a pressurizing member that nips the recording sheet together with the fixing member to pressurize the toner image on the recording sheet;

a heater that heats the pressurizing member; and a hardware processor that controls a heating temperature of the pressurizing member by the heater, wherein the hardware processor acquires a setting of glossiness of the toner image to be formed on the recording sheet, and based on the acquired setting of the glossiness, the hardware processor controls the heating temperature of the pressurizing member, wherein toner particles constituting the toner image contain 0.05 to 0.40% of a metal element that ionically crosslinks a binder resin.

6. The fixing device according to claim 5, wherein the metal element contains aluminum or magnesium.

7. An image forming device comprising: the fixing device according to claim 1; and an image former that forms the toner image.

8. A method for manufacturing a printed matter in which a toner image is formed on a recording sheet in an image forming device, the image forming device including: a fixing member and a pressurizing member that nip the recording sheet in order to fix the toner image on the recording sheet; and a heater that heats the pressurizing member, the method comprising:

acquiring a setting of glossiness of a toner image to be formed on a recording sheet;

setting a condition for heating the pressurizing member in accordance with the setting of the glossiness;

forming the toner image on the recording sheet; and fixing the toner image on the recording sheet in accordance with the condition using the fixing member and the pressurizing member, wherein toner particles constituting the toner image contain 0.05 to 0.40% of a metal element that ionically crosslinks a binder resin.

9. The method for manufacturing a printed matter according to claim 8, wherein the metal element contains aluminum or magnesium.

* * * * *